US008256098B2

(12) United States Patent
Michael

(10) Patent No.: US 8,256,098 B2
(45) Date of Patent: Sep. 4, 2012

(54) SWITCHABLE CORE ELEMENT-BASED PERMANENT MAGNET APPARATUS

(75) Inventor: Jim G Michael, Parker, CO (US)

(73) Assignee: Creative Engineering Solutions, Inc., Parker, CO (US)

( * ) Notice: Subject to any disclaimer, the term of this patent is extended or adjusted under 35 U.S.C. 154(b) by 0 days.

(21) Appl. No.: 13/402,605

(22) Filed: Feb. 22, 2012

(65) Prior Publication Data

US 2012/0174368 A1 Jul. 12, 2012

Related U.S. Application Data

(62) Division of application No. 12/757,320, filed on Apr. 9, 2010, now Pat. No. 8,183,965.

(51) Int. Cl.
*H01F 7/02* (2006.01)
*H01F 7/20* (2006.01)
*H01F 7/06* (2006.01)

(52) U.S. Cl. ..... 29/607; 335/284; 335/285; 335/286; 335/295; 335/296; 335/302; 335/306; 335/288

(58) Field of Classification Search ..... 335/284–288, 335/295–298, 302, 306; 29/607
See application file for complete search history.

(56) References Cited

U.S. PATENT DOCUMENTS 2,347,023 A 4/1944 Beechlyn
3,059,156 A 10/1962 Moriya et al.
3,184,654 A * 5/1965 Bey ..... 335/295
3,452,310 A 6/1969 Israelson
4,055,824 A 10/1977 Baermann
4,250,478 A 2/1981 Cardone et al.
4,251,791 A 2/1981 Yanagisawa et al.
4,314,219 A 2/1982 Haraguchi
4,329,673 A 5/1982 Uchikune et al.
4,393,363 A 7/1983 Iwasaki
4,401,960 A 8/1983 Uchikune et al.
4,401,961 A 8/1983 Baermann et al.
4,419,644 A 12/1983 Baermann
4,465,993 A 8/1984 Braillon
4,921,292 A 5/1990 Harwell et al.
5,166,654 A 11/1992 Doyelle
5,266,914 A 11/1993 Dickson et al.
5,435,613 A 7/1995 Jung
6,076,873 A 6/2000 Jung
6,107,906 A 8/2000 Caiozza
6,246,561 B1 6/2001 Flynn
6,573,817 B2 * 6/2003 Gottschalk ..... 335/306
6,663,154 B2 12/2003 Pancheri
6,707,360 B2 3/2004 Underwood et al.
7,009,480 B2 3/2006 Tsui et al.

(Continued)

*Primary Examiner* — Mohamad Musleh
(74) *Attorney, Agent, or Firm* — Christopher A. Taravella

(57) ABSTRACT

A method for producing a switchable core element-based permanent magnet apparatus, used for holding and lifting a target, comprised of two or more carrier platters containing core elements. The core elements are magnetically matched soft steel pole conduits attached to the north and south magnetic poles of one or more permanent magnets, inset into carrier platters. The pole conduits contain and redirect the permanent magnets' magnetic field to the upper and lower faces of the carrier platters. By containing and redirecting the magnetic field within the pole conduits, like poles have a simultaneous level of attraction and repulsion. Aligning upper core elements "in-phase," with the lower core elements, activates the apparatus by redirecting the magnetic fields of both pole conduits into the target. Anti-aligning upper core elements "out-of-phase," with the lower core elements, deactivates the apparatus resulting in pole conduits containing opposing fields.

8 Claims, 41 Drawing Sheets

U.S. PATENT DOCUMENTS 7,012,495 B2 * 3/2006 Underwood et al. ..... 335/288
7,161,451 B2 * 1/2007 Shen ..... 335/289
7,224,251 B2 5/2007 Wang
7,843,297 B2 * 11/2010 Fullerton et al. ..... 335/306

* cited by examiner

Section A-A

SWITCHABLE CORE ELEMENT-BASED PERMANENT MAGNET APPARATUS

This specification is the specification for a divisional application and pursuant to the provisions of 35 U.S.C. §§120 and 121 claiming the benefit of the filing date of the original application, USPTO application Ser. No. 12/757,320, filed Apr. 9, 2010 now U.S. Pat. No. 8,183,965.

BACKGROUND OF THE INVENTION

1. Field of the Invention

Manually actuated magnetic fields in permanent magnet chucks, holders, and lifting devices have been used for decades on ferromagnetic materials (targets). Common applications are seen on mills, grinders, lathes, drills, and other industrial and commercial equipment. Other applications include fixtures, tool and gauge holders, material alignment, and holding fixtures. Various permanent magnet-based lifters are used for material handling and robotic pick-and-place equipment. Unfortunately, the majority of these switchable permanent magnets have relatively low magnetic performance-to-weight ratios. Consequently, magnetic chucks, holders, and lifting devices are often costly or heavy and bulky in order to meet performance objectives.

Permanent magnets produce their own persistent magnetic fields. Permanent magnets have both a north ("N") and a south ("S") pole. By definition, the direction of the local magnetic field is the direction that the north pole of a compass (or of any magnet) tends to point. Magnetic field lines exit a magnet near its north pole and enter near its south pole but inside the magnet, the field lines return from the south pole back to the north pole. The "magnetic pole separation line" is used to depict a theoretical plane between the north and south poles of the permanent magnet. Permanent magnets are made of ferromagnetic materials such as iron and nickel that have been magnetized. The strength of a magnet is represented by its magnetic moment ("M"). For simple magnets, M points in the direction of a line drawn from the south to the north pole of the magnet. "Like" magnetic poles, for example, N and N or S and S, when brought near each other repel, while "opposite" magnetic poles, for example, N and S, attract.

All permanent magnets and materials that are strongly attracted to them are ferromagnetic. When the magnetic moment of atoms within a given material can be made to favor one direction, they are said to be "magnetizable." Ferromagnetism is the basic mechanism by which certain materials form or exhibit strong interactions with magnets.

A material that is magnetically soft is similar to permanent magnets in that it exhibits a magnetic field of its own when in the influence of an external magnetic field. However, the material does not continue to exhibit a magnetic field once the applied field is reduced to zero. Such materials act as a "conduit" carrying, concentrating, and shaping magnetic fields. Proper matching (as described in the Detailed Description of the Invention) of this "conduit" to a specific magnet or group of magnets aligned with common pole orientation, that is, all north poles on one side and all south poles on the opposite side, define a "pole conduit".

Affixing a properly matched pole conduit to each side of a permanent magnet's or magnets' magnetic poles defines a basic core element. Pole conduits contain and redirect a permanent magnet's magnetic field to the upper and lower faces of the pole conduits. Each pole conduit affixed to the permanent magnet now contains the magnetic field and pole direction of the permanent magnet so that one pole conduit of the core element contains the permanent magnet's north field and the other pole conduit contains the permanent magnet's south field.

By containing and redirecting the magnetic field within the pole conduits, like poles have a simultaneous level of attraction and repulsion. Relative positioning of two or more core elements is critical for proper operation of the apparatus. Aligning upper core element pole conduits with lower core element pole conduits "in-phase", that is, north-north/south-south (N-N/S-S), activates the apparatus by redirecting the combined magnetic fields of the adjacent pole conduits into a target. Upper and lower core elements anti-aligned or "out-of-phase," that is, north-south/south-north (N-S/S-N), results in the adjacent pole conduits containing opposing fields and deactivation of the apparatus.

A core element must function as a single entity and may require containment of its separate components into a "carrier platter" in order to facilitate the relative positioning of two or more core elements with respect to each other. The carrier platter further allows for incorporation of two or more core elements into other devices as described further in the Detailed Description of the Invention.

Ferromagnetic materials like iron that show saturation are composed of magnetic domains in microscopic regions that act like tiny permanent magnets. Before an external magnetic field is applied to the material, the magnetic domains are oriented in random directions and thus cancel each other out. When an external magnetizing field "H" is applied to the material, it penetrates the material and aligns the domains, causing their tiny magnetic fields to turn and align parallel to the external field, adding together to create a large magnetic field which extends out from the material. This is called "magnetization": the stronger the external magnetic field, the more the domains align. Saturation occurs when practically all of the magnetic domains are aligned, so further increases in the applied field cannot cause further alignment of the magnetic domains.

Target saturation is very similar to magnetic saturation in that once all of the magnetic domains in the target material directly under the pole conduit or magnet are saturated, any excess magnetic field cannot be absorbed. If a switchable permanent magnet produces a field in excess of what a target can absorb, the excess magnetic field will result in increased actuation force. Actuation force is the force required to overcome the magnetic resistance between two or more adjacent core elements when orienting one core element with respect to the adjacent core element so as to be aligned in-phase (N-N/S-S). This excess magnetic field must be overcome when rotating adjacent magnetic carrier platters in-phase. Actuation force to align core element pairs can be ten times greater in air or on a very thin target than when on a target that does not fully saturate (absorb the entire magnetic field).

Breakaway force is the force required to separate a magnet perpendicularly from a target. Most magnets are tested on a target with sufficient thickness to avoid oversaturation in the area directly under the pole or poles. Since the breakaway strength is primarily a function of the pole area and the saturation of the material, it is the material and not the magnetic field that determines the breakaway force once a target thickness has become saturated. A magnet that has a breakaway force of 100 Newtons on material 25 mm in thickness may also be at 100 Newtons on material 12 mm in thickness but drop to 70 Newtons on material 6 mm in thickness and 10 Newtons on material 2 mm in thickness.

Magnetic permeability (dimensionless as it is relative to magnetic permeability of a vacuum or air) can often be considered as magnetic conductivity. There are essentially four categories of magnetically permeable substances: (1) Substances whose magnetic permeability is less than one are said to be diamagnetic. These substances to a very small extent produce an opposing magnetic field in response to a strong magnetic field. Because this response is often extremely weak, most non-physicists would consider diamagnetic substances to be nonmagnetic; (2) Substances whose magnetic permeability is exactly one are said to be nonmagnetic. Air or a vacuum has a magnetic permeability of one; (3) Substances with a magnetic permeability greater than one are said to be paramagnetic; and (4) Substances with a magnetic permeability much greater than one (100 to 100,000) are said to be ferromagnetic. This invention primarily deals with targets that are ferromagnetic.

FIGS. 4A and 4B refer to a combination of magnets 104*a*, 104*b*, 105*a*, 106*a*, 106*b*, 107*a* and 107*b* with matched pole conduits 102*a* and 102*b* affixed to the permanent magnets' magnetic pole faces, and are defined to be a core element 101. Pole Conduit 102*a* is affixed and adjacent to the north poles of permanent magnets 104*a*, 104*b*, 105*a*, 105*b*, 106*a*, 106*b*, 107*a* and 107 and pole conduit 102*b* is affixed and adjacent to the south poles of permanent magnets 104*a*, 104*b*, 105*a*, 105*b*, 106*a*, 106*b*, 107*a* and 107. Pole conduit 102*a* is now considered to be a north pole conduit while pole conduit 102*b* would be considered a south pole conduit. Pole conduit 102*a* and 102*b* are now able to redirect the magnetic field within them to a perpendicular surface 108*a* and 108*b* respectively. The perpendicular surfaces 108*a* and 108*b* are used to conduct and redirect the magnetic fields within the pole conduits to either an adjacent core element or to a ferromagnetic target.

Phase alignment occurs when pole conduits of two or more core elements are aligned and effectively adjacent to each other. For example, referring to FIG. 15A, core elements 101*b* and 101*a* are said to be out-of-phase or anti-aligned when north pole conduit 102*c* is directly above south pole conduit 102*b* and south pole conduit 102*d* is directly above north pole conduit 102*a*. Conversely, referring to FIG. 15B, core elements are said to be in-phase when north pole conduit 102*c* is directly above north pole conduit 102*a* and south pole conduit 102*d* is directly above south pole conduit 102*b*. In-phase alignment of core elements results in a repulsive force between the pole conduits (magnetic repulsion) in addition to a moderately strong external magnetic field. Out-of-phase alignment of core elements results in a strong attractive force (magnetic coupling) between the pole conduits along with very little external magnetic field.

Aligning or placing core element 101*b* in-phase with another core element 101*a*, as illustrated in FIG. 15B, activates (or actuates) a very strong external magnetic field, provided by an in-phase "magnetic coupling" between the pole conduits that have a simultaneous attractive and repulsive force. Core elements 101*a* and 101*b* that are anti-aligned or placed out-of-phase also provide a "magnetic coupling" as illustrated in FIG. 15A. This out-of-phase "magnetic coupling" provides a very strong attractive force between the adjacent pole conduits with little or no external magnetic field; that is, the external magnetic field is deactivated or de-actuated. In-phase core elements in contact with an unsaturated ferromagnetic target have a mildly attractive force between the core elements.

Magnetic field lines provide a simple way to depict or draw the magnetic field. The magnetic field can be estimated at any point using the direction and density of the magnetic field lines nearby. Typically the stronger the magnetic field, then the higher the density of the magnetic field lines.

The magnetic field lines depicted in FIG. 21 provide a visible two dimensional representation of a typical magnetic field. The "visible" field line depicted is not precisely the same as that of an isolated magnet. The introduction of metal filings alters the magnetic field by acting as a pole conduit and redirecting the field. While the filings are shown in a two-dimensional perspective, a three-dimensional field would look similar to an hour glass.

2. Prior Art

U.S. Pat. No. 4,329,673 issued to Uchikune (1982) describes a switching permanent magnet configuration that uses short circuiting of the north and south poles of a diametrically polarized circular magnet into two steel pole plates to deactivate the magnetic circuit (commonly referred to as shunting).

U.S. Pat. No. 4,329,673 issued to Uchikune (1982), is designed so that the apparatus activates when a diametrically polarized circular magnet is rotated 90°, so that the north and south poles of the permanent magnet are aligned perpendicular to the two isolated magnetically soft pole plates, such that one pole plate is magnetized north and the other pole plate is magnetized south. These pole plates are typically separated with a nonferrous material to avoid short circuiting of the field. To deactivate the apparatus, the diametrically polarized magnet is rotated back 90° from the activated state so that the magnetic pole separation line is now aligned perpendicular with each of the magnetically soft pole plates. By aligning the magnetic pole separation line into each of the pole plates, both the north and south pole magnetic fields of the diametrically polarized permanent magnet are directed into each side of the magnetically soft pole plates and are effectively short-circuited. This basic design is relatively inefficient due to the fact that the pole plates must be of sufficient mass to adequately short-circuit the north and south pole magnetic fields without becoming oversaturated. Pole plate mass is determined by using the minimal mass required to eliminate any residual magnetic field emanating from the magnetic poles When the unit is deactivated. When activated, a substantial portion of the magnetic field is absorbed into the large steel plates substantially reducing the performance-to-weight ratio.

U.S. Pat. No. 7,012,495 B2 issued to Kocijan (2006) FIG. 1 Prior Art, describes a diametrically polarized (magnetized) magnet 21, which has a north pole region 23 separated by a diameter 24 (magnetic pole separation line) of the cylindrical surface through the height of the magnet from the south pole region.

U.S. Pat. No. 7,012,495 B2 issued to Kocijan (2006) (FIG. 2—Prior Art) identifies a switchable magnet configuration comprised of a housing 32 and 33 that contains a first permanent magnet 30, a second permanent magnet 31 an actuation means (34, 35, 36, 37, 38, 39, 40, 41, 42, 43 and 44) to cause relative rotation between the first and second magnets. The magnets 30, 31 are diametrically polarized as shown in FIG. 1—Prior Art. The relative rotation between the upper magnet 31 and the lower magnet 30 allows for a more effective means of cancelling the magnetic field when the magnets are oriented north-south. The field cancellation allows the use of a smaller mass of steel for each pole 32 and 33 than the Uchikune design referenced earlier (U.S. Pat. No. 4,329,673). By reducing the steel pole size, more of the magnetic field is available to attract the target, thereby improving the magnet performance-to-weight ratio.

The functional design described by U.S. Pat. No. 7,012,495 B2 issued to Kocijan (2006) is commercially available and depicted by FIG. 3A Prior Art and FIG. 3B Prior Art. Magnet 58 is affixed to the single piece housing 55 (press fit and/or bonded) with diametrically polarized field line 54 perpendicular to the thin wall of the housing 56. A low friction disc 53 is inserted into housing 55 in between the lower magnet 58 and the upper rotatable magnet 52. Rotation of the upper magnet 52 is accomplished through the use of drilled holes 50 and 51 to accommodate a mechanical linkage 60. In order to rotate upper magnet 52 with respect to the lower magnet 58, a clearance 61 is required between the housing 55 and the upper magnet 52. The clearance can be accomplished by machining a larger diameter into housing 55 or by using a smaller diameter upper magnet 52 than lower magnet 58. The magnetic field of the two magnets 52 and 58 is directed into magnet poles (pole conduits) 57 and 59.

The switchable permanent magnetic device described in U.S. Pat. No. 7,012,495 B2 issued to Kocijan (2006) is considerably more efficient than the switchable permanent magnet holding device described in U.S. Pat. No. 4,329,673 issued to Uchikune (1982). That said, the design described by U.S. Pat. No. 7,012,495 B2 issued to Kocijan (2006) requires tight manufacturing tolerances and is relatively expensive to produce. Manufacture of the single piece housing 55 is both material and labor intensive. Machining of a single piece housing 55 (FIG. 3B Prior Art) requires the use of relatively thick solid material (over twice the thickness of either magnet) that is primarily machined away. The clearance 61 (FIG. 3B Prior Art) must have a very smooth finish to avoid scraping off the magnet's plating and it must always accommodate the tolerances of the upper magnet 52 (FIG. 3B Prior Art). Additionally, clearance 61 (FIG. 3B Prior Art) is a substantial air gap that diminishes the magnetic field transfer into the magnet pole pieces 57 and 59 and often must be overcome by use of a stronger, more expensive composition upper magnet 52 than lower magnet 58. Rotation of the upper magnet 52 also requires that a locating feature 50 and 51 be machined into the upper magnet. These features not only weaken the upper magnet's integrity (exposing it to possible breakage), but also negatively affects the quality of the magnetic field. Permanent magnets are made of exceptionally hard brittle materials that oxidize rapidly in air. This is particularly true of neodymium magnets (NdFeB—neodymium iron boron). By having to attach a rotational feature 60 to the upper magnet, the magnet manufacturer must produce custom magnets that have holes 50 and 51 (FIG. 3A Prior Art) or other locating features machined 34 and 35, as seen in FIG. 2 Prior Art, into the magnet blanks before magnetizing and plating. This often requires long lead times, costly tools, large volume purchases, and high prototype expenses. Moreover, locating these features accurately along the magnetic pole separation line 24 (FIG. 1 Prior Art) is difficult and if off more than a few degrees, can result in nonfunctional or compromised performance of the switchable permanent magnet devices. Diametrically polarized magnets also have inherently reduced magnetic efficiencies as the size increases.

A further drawback to U.S. Pat. No. 7,012,495 B2 issued to Kocijan (2006) is the need for top actuation. By having the upper magnet 31 (FIG. 2 Prior Art) inset into the housing 32 and 33, actuation must take place above a lid 43 (FIG. 2 Prior Art). It is often desirable to affix a device to the top surface of the switchable magnet apparatus. Attachment to the device described in U.S. Pat. No. 7,012,495 B2 issue to Kocijan (2006) is often done to one of the vertical sides (resulting in off-center loading) or to a larger yoke style mount that is affixed to opposite vertical surfaces of the poles 32 and 33 (FIG. 2 Prior Art), yet still provides sufficient room to activate or deactivate the device by rotating a knob or lever 180°.

The Switchable Core Element-Based Permanent Magnet Apparatus has several advantages when compared with the prior art:

Ease of actuation: Actuation can be performed by rotational movement of the entire exterior of the upper carrier platter including the top and the sides, allowing far more flexibility for integration into products and fixtures and for easier attachment of peripherals to the apparatus;

Reduced magnet cost: The highly flexible architecture of the invention allows for immediate adaptation of off-the-shelf magnets. As an added benefit, the use of multiple smaller magnets in the core elements can result in a greater magnetic force than a larger single magnet. For specialized applications where a custom magnet is used, it is unnecessary to machine in any special locating features 34 and 35 (FIG. 2 Prior Art) or attachment features into the magnets. Prototyping is now reduced to days instead of months;

Reduced manufacturing tolerances: Simpler magnet shapes that do not require complex machining and field orientation substantially reduce the risk of product failure;

Stronger, more robust design: Elimination of features machined into the magnet substantially increases the magnet's structural strength. Encapsulation of a magnet into a ferrous or nonferrous carrier platter dramatically reduces the risk of magnet damage due to impact or tensional stress forces from the mechanical linkage 60 (FIG. 3*a* Prior Art) or as described by mechanical linkage 36, 37 and 38 (FIG. 2 Prior Art);

More efficient magnet use: Elimination of the air gap 61 (FIG. 3B Prior Art) required to orient the magnetic poles, allows the use of a lower cost magnet composition. Air gap 613 between stacked pole conduits 301*a* and 301*b* as depicted in FIG. 16B, can be made much tighter than air gap 61 between magnet 52 and housing 55 (FIG. 3B Prior Art). The Prior Art design referenced in FIG. 3A must account for machining tolerances of mild steel that is bored into a material with a variable wall thickness (prone to flexure during machining), diameter and concentric variations of custom run magnet material (length cuts are more accurate), off center hole locations 50 and 51 (centers the magnet within the housing), variations in the mechanical linkage 60, variations in the housing 55 due to plating, and variations in the magnets 52 and 58 due to plating and tolerance variation in the lid; and Lower cost materials—By using a pole conduit that only needs to be slightly thicker than the magnet(s) and approximately the same thickness as the carrier platter, material costs are dramatically reduced. As an example, if U.S. Pat. No. 7,012,495 B2 issue to Kocijan (2006) used two 25 mm thick magnets it would necessitate the purchase of plate steel that is over 52 mm thick (60 mm stock thickness) or to start with large diameter solid rod that is rough cut, machined on a lathe and then machined on a mill. By using separate carrier platters, 25 mm thick plate may be plasma rough cut and final bored on a low cost machining center or extruded and cut to length with very little post machining.

BRIEF SUMMARY OF THE INVENTION

This invention pertains to a switchable, core element-based, permanent magnet apparatus. Specifically, the invention pertains to a magnetic holding device comprised of two or more carrier platters. Each carrier platter contains a core element with pole conduits perpendicular to the magnetic pole separation line such that both the north and south poles of the magnets have their respective magnetic field directed through the pole conduits to the top and bottom surfaces of each carrier platter. A core element is comprised of one or more permanent magnets, each of which has a pole conduit positioned on both the north pole or poles and south pole or poles of the magnet or magnets with the pole conduits effectively isolated from each other.

The switchable core element-based permanent magnet apparatus design provides a unique construction that allows for an extremely compact design offering an exceptional performance-to-weight ratio, highly flexible architecture, reduced cost, speed to production, and simple actuation.

DETAILED DESCRIPTION OF THE INVENTION

Figure 1:
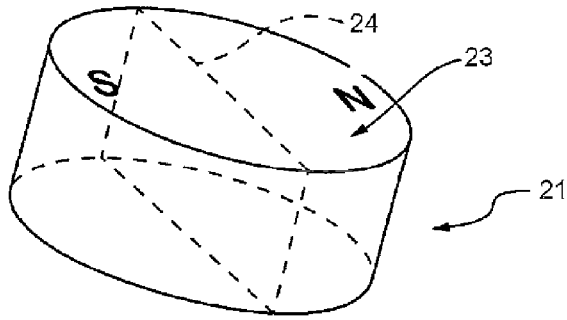
Fig. 1 Prior Art
FIG. 1 Prior Art is a diametrically polarized (magnetized) magnet.
Figure 2:
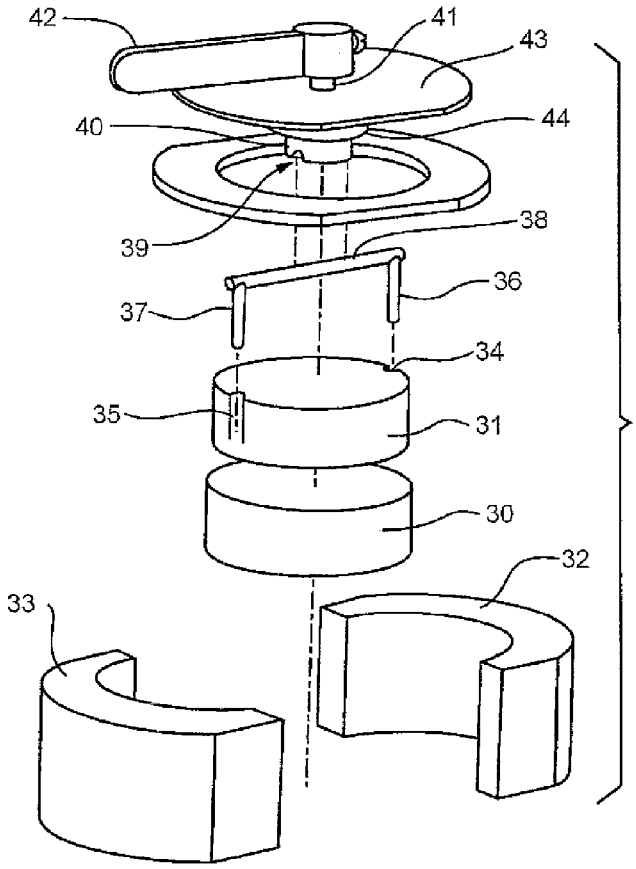
Fig. 2 Prior Art
FIG. 2 Prior Art is a switchable magnet configuration.
Figure 3A:
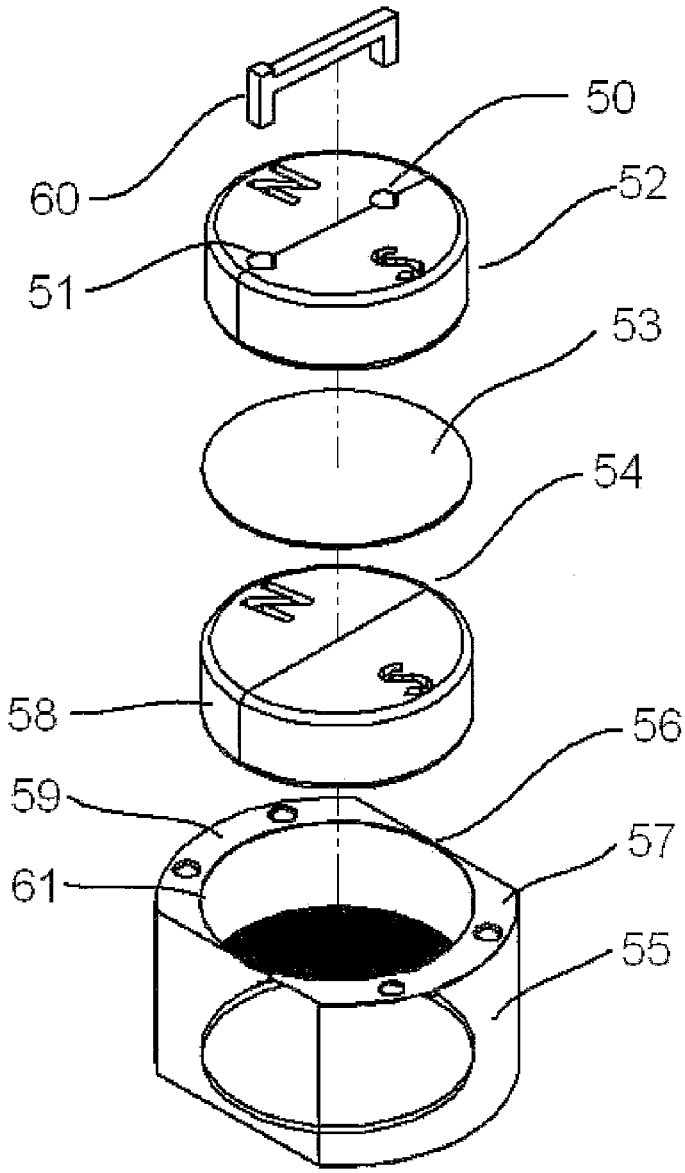
Fig. 3A Prior Art
FIG. 3A Prior Art is an exploded view if a switchable magnet.
Figure 3B:
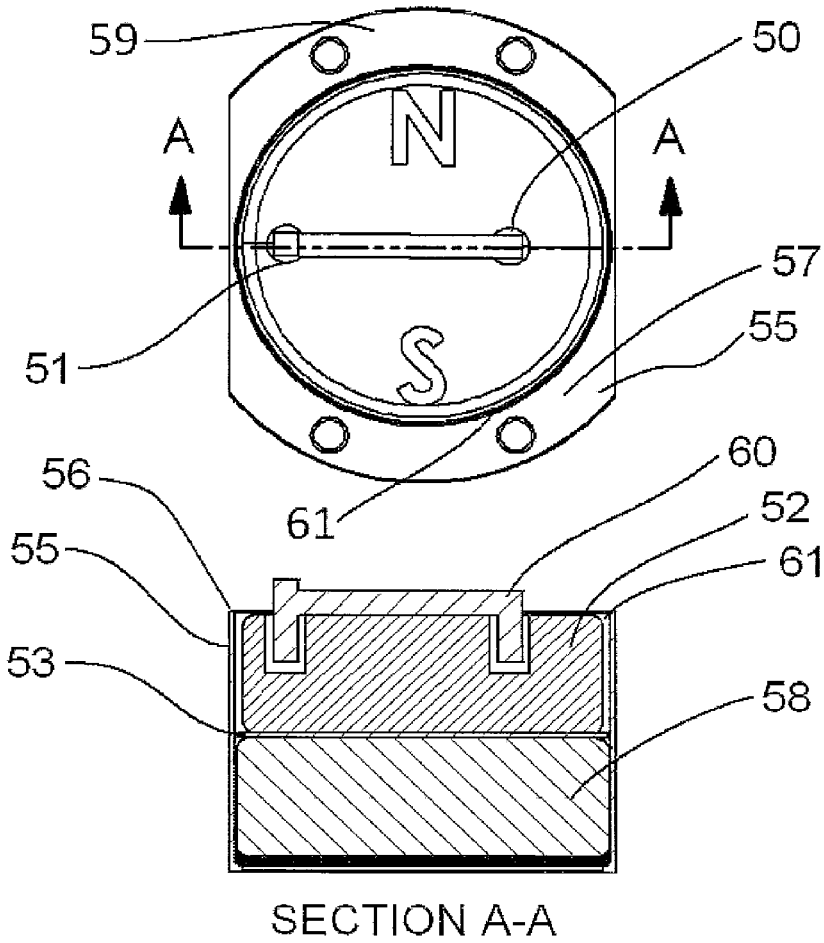
Fig. 3B Prior Art
FIG. 3B Prior Art is the top view if FIG. 3A Prior Art.

The apparatus has various embodiments as described herein. Invariably however, the first six steps in making the embodiments of the switchable core element permanent magnet apparatus are the same. These steps are magnet selection, pole conduit matching, core element design, design and operational considerations, and additional considerations.

Magnet Selection

As a starting point for any switchable core element apparatus, the designer typically has a minimum strength or force that the apparatus must possess in order to function adequately for a particular task or requirement. Since the apparatus contains at least two magnets, each magnet needs only approximately half of the total strength of the apparatus. Since the strength of a magnet is always specified in terms of infinitely thick targets, the particular magnets should be tested on the intended target for verification of performance prior to selection.

In addition to strength, the shape and design of the magnet can have significant impact on the performance of the apparatus. If the designer has selected a rectangular cuboid magnet, the apparatus will typically perform better if the faces with the largest area are also the pole faces. In addition, the smallest magnet dimension at its pole face should be between 1 and 2.5 times thicker than that of the intended target of the apparatus. To maximize magnet weight to performance efficiency the magnet length (Lm) should be close to the magnet height and the magnet width is ideally greater than 1.5 to three times the magnet's width. It may be advantageous to substitute multiple smaller magnets with the same magnetic length and approximately the same volume. This often yields superior performance to that of a single magnet. The orientation of the magnet's N-S field must be radial with respect to the apparatus.

Pole Conduit Matching

There are two primary functions for the pole conduits. The first is to contain the anti-alignment or out-of-phase (N-S/S-N) magnetic fields of two or more desired magnets so that no magnetic flux emanates from the pole conduit's contact surface area, deactivating the apparatus. The second function of the pole conduit is to redirect the combined and aligned or in-phase magnetic pole fields of two or more magnets, activating the apparatus.

The pole conduits are ideally constructed of a magnetically soft material such as mild steel. Ideally, two pole conduits 102*a* and 102*b* must come into contact with each of the magnets' pole faces 110*a* and 110*b* as depicted in FIG. 4C. The surface area of the contact interface between the magnet's pole face 110*a* and the adjacent pole conduit's magnet surface contact face 111*a* must be at least 25% of the surface area of the magnet's pole face 110*a*. The second dimensional requirement for the pole conduit is that the top or bottom surface of pole conduits 108*a* and 108*b* that comes into contact with either the target or an adjacent pole conduit in the carrier platter above or below is ideally 75% of the surface area of the magnets' pole face area 110*a* and 110*b* as depicted in FIG. 4C. This ratio, more fully explained below, is hereafter referred to as the "Pole Surface Ratio of the Conduit." Exceeding the pole surface ratio of the conduit does so at the expense of performance and excessive weight of the apparatus. Using a smaller pole surface ratio of the conduit will often result in an apparatus that will fail to deactivate fully.

In the case of cylindrical or disk shaped magnets that are diametrically polarized, the pole surface area is best estimated as the pole surface area of the smallest rectangular cuboid that can completely contain the cylindrical or disk shaped magnet in question.

It should be stressed that the pole conduits need not cover the entire surface area of the magnet's pole surfaces. Pole conduits may also extend past the width of the magnetic pole face if needed by as much as 200% or possibly higher.

The remaining criterion for the pole conduit is shape. Ideally, the shape of the pole conduit is such that it conducts the magnet field as efficiently as possible. Consequently, pole conduits should not be hollow or contain nonmagnetically soft obstructions such as holes or stainless steel screws. Care should be exercised to assure smooth field flow through the pole conduit in order to realize maximum field conduction efficiency. It is best to avoid reversal of directions or sharp corners and turns. Often semicircular or elliptical shapes that follow the natural field flow of the magnet are ideal.

Core Element Design

Figure 10:
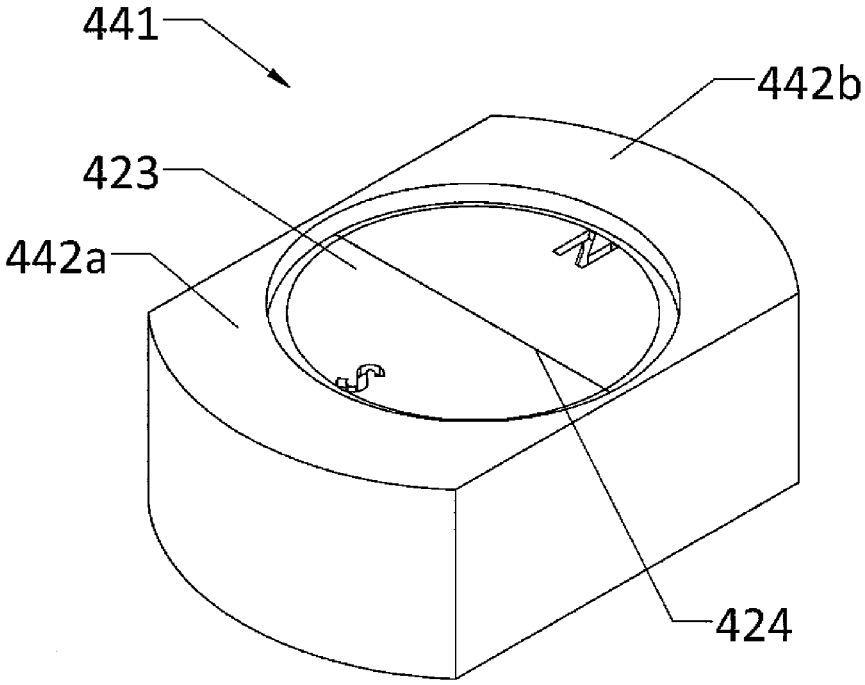
FIG. 10 is an oblique view of a single core element embodiment comprised of a single diametrically polarized disc-shaped permanent magnet affixed into a single magnetically soft steel pole conduit that is cylindrical in shape on both ends with minimal wall thickness between the magnet pole conduits.

Once the magnet and general pole conduit shape have been determined, a core element is effectively constrained. Manufacturing constraints are now used to finalize the core element design. Production quantity and material availability often dictate the final configuration of the core element. If it is desirable to make a variety of core elements that can be integrated into a wide range of applications, a single structure containing the magnet and two pole conduits can be produced as shown in FIG. 10. A wide range of standard sizes using this style of core element can be produced and characterized so that a customer need only to specify basic criteria such as lifting force and target material thickness.

Design and Operational Considerations

Product use and environmental concerns will govern the design of the carrier platters. Several examples have been depicted in this application to address many of these questions.

Figure 16A:
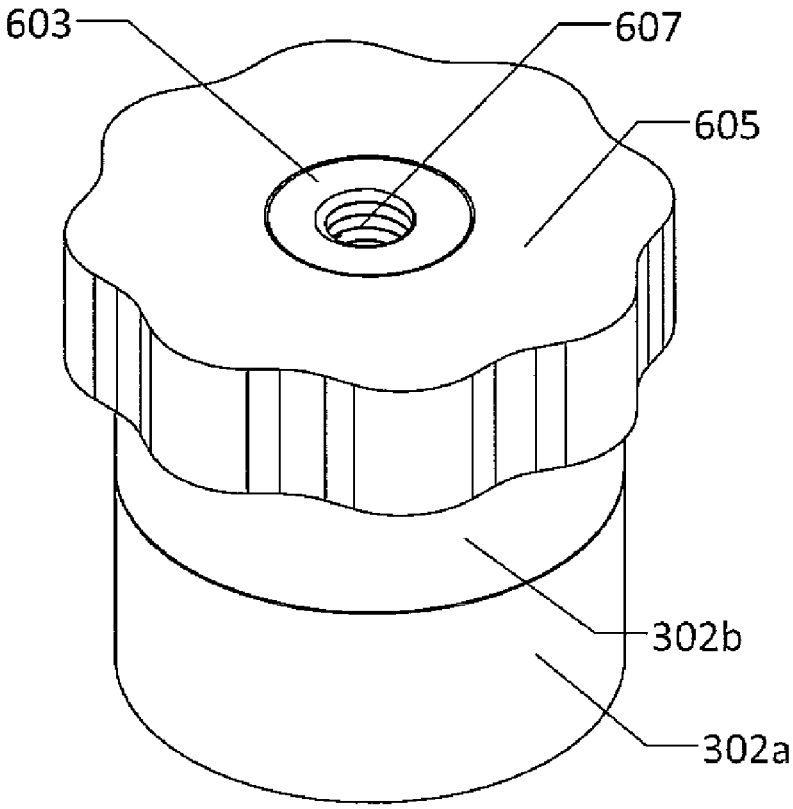
FIG. 16A is an oblique view of a fixed top mount, manually actuated, diametrically polarized ring-shaped permanent magnet apparatus.
Figure 16B:
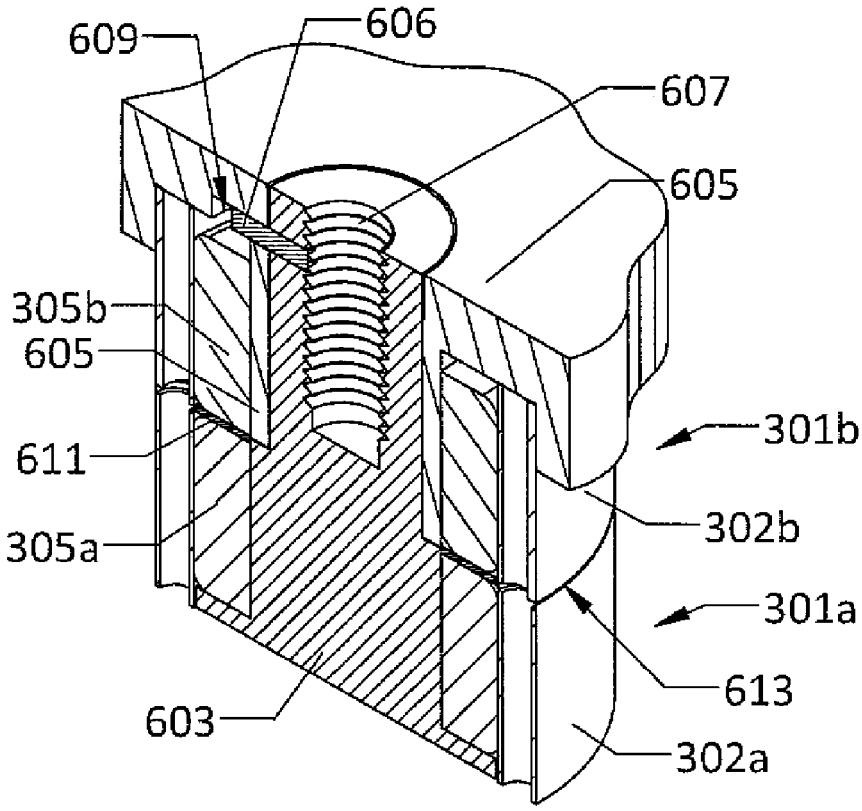
FIG. 16B is an oblique sectioned view of the embodiment depicted in FIG. 16A.
Figure 16C:
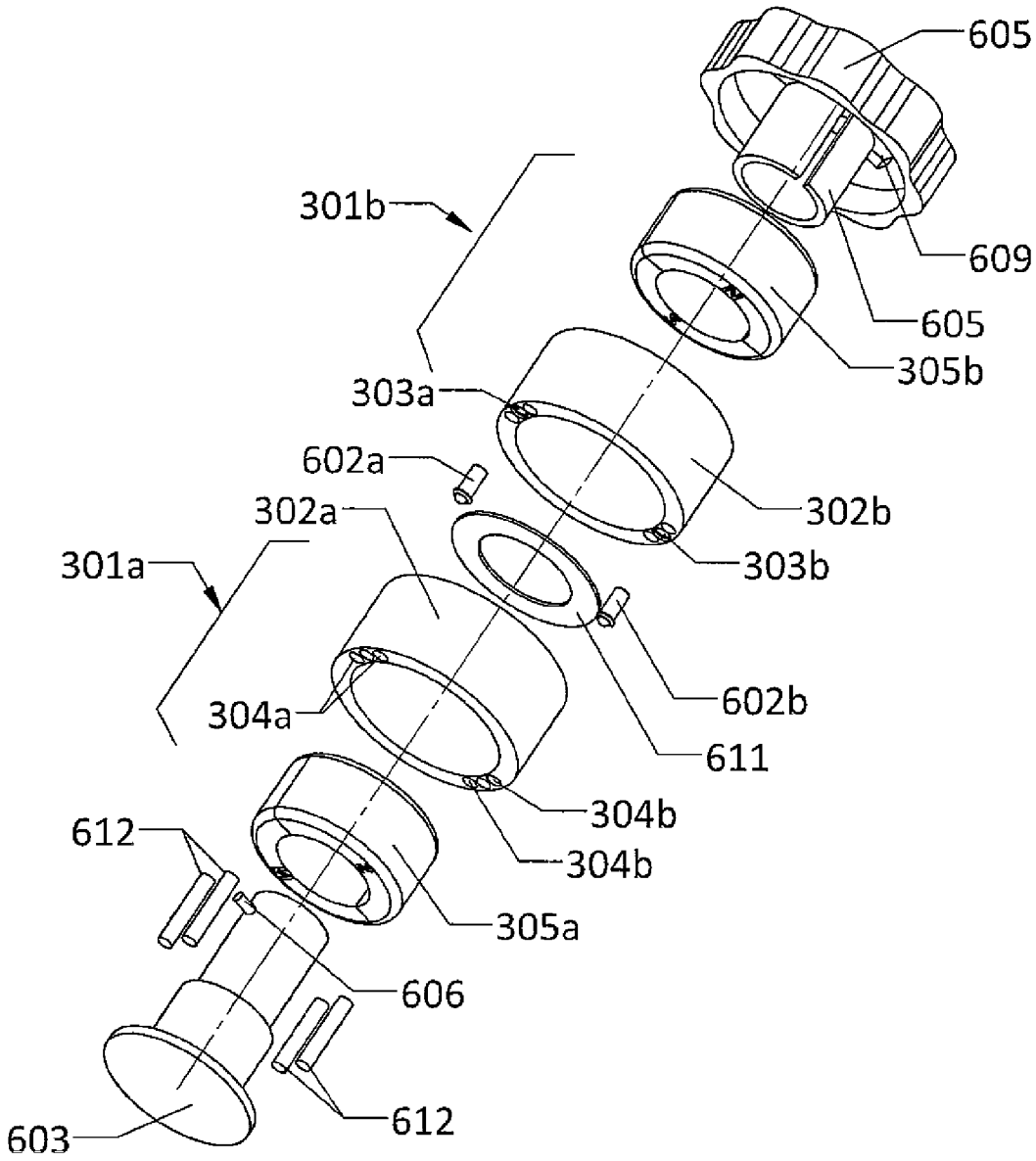
FIG. 16C is an oblique exploded view of the embodiment depicted in FIG. 16A.

A fixturing tool such as a magnetic dial base indicator holder intended for sale to the public should consider the embodiment described by FIGS. 16A, 16B and 16C as a possible design. Ideally, the footprint is compact and assembly is simplified. As the apparatus must function on a relatively wide range of materials of variable thicknesses, magnetic force needs only to be a factor of roughly 5 times the overall mass of the apparatus. Given this application, a core element should be contained within a non-ferromagnetic housing (aluminum or plastic) that shields the core element from debris while reducing weight.

To further reduce product complexity, the core element may be incorporated into a ferromagnetic carrier platter. Since this particular product will generally be used on unpainted or un-plated surfaces and ultimate strength/magnetic performance is not as critical as cost, incorporating the core element into the carrier platter can substantially reduce production costs and simplify assembly while still exceeding the performance and efficiency of currently available products. A rotation limiting mechanism capable of substantially locking and unlocking one carrier platter's magnetic pole orientation with respect to the adjacent carrier platters magnetic pole orientation may also be incorporated into the carrier platter as well. Such mechanism may be, by way of example and not limitation, a pin, bar, detent, or the like.

Additional Considerations

The force necessary to actuate the magnetic force must be reduced by minimizing any friction between the carrier platters. When deactivating the device, there is a strong attraction between the carrier platters. This attractive force must be overcome either by preventing contact between the platters or by using a very low friction material between the two platters, with the simplest method being the use of a very low friction material between the two platters. This may be accomplished, for example and not by way of limitation, through the use of bearings, air gaps, lubricants, low friction finishes or coatings, polytetrafluoroethylene ("PTFE") discs or rings, or other materials suitable for the desired number of life cycles and compressive force.

In many cases manufacturing constraints create the need for a thicker low friction material or air gap between the carrier platters. A simple solution to overcome this issue is by using a stronger core element in the carrier platter that does not come into contact with the work surface. The core element can be made stronger through many methods including, stronger magnets, using more magnet volume, using different shaped magnets that can fit more closely together, or using different pole conduits shapes and materials. This will allow for complete neutralization or even a reversal of the magnetic pole conduit field emanating from the pole conduit which comes into contact with the work surface. However, there will now be a residual magnet field emanating from the core element not in contact with the target work surface. Isolation of this residual magnetic field when deactivated can be achieved if required through a variety of methods, including without limitation, encasing the upper core element 101*b* of FIG. 15C with a non magnetic material of sufficient thickness or by further adding an optional magnetic material around a thinner non-magnetic casing.

Automated actuation requires consideration of several factors. In addition to other considerations, the substantial increase in the number of cycles that the apparatus will experience (50,000 to 5,000,000) must be considered. Actuations in the millions of cycles require non contact surfaces or the use of ball bearings. Performance to weight ratio is critical, while the use of standardized actuation components is necessitated for field repairs. Actuation methods are often several times the size and weight of the switchable core element-based permanent magnet apparatus. It can be of significant economic and design benefit to minimize the actuation force required thereby reducing the cost, complexity, and the power requirements of the actuation.

Figure 18A:
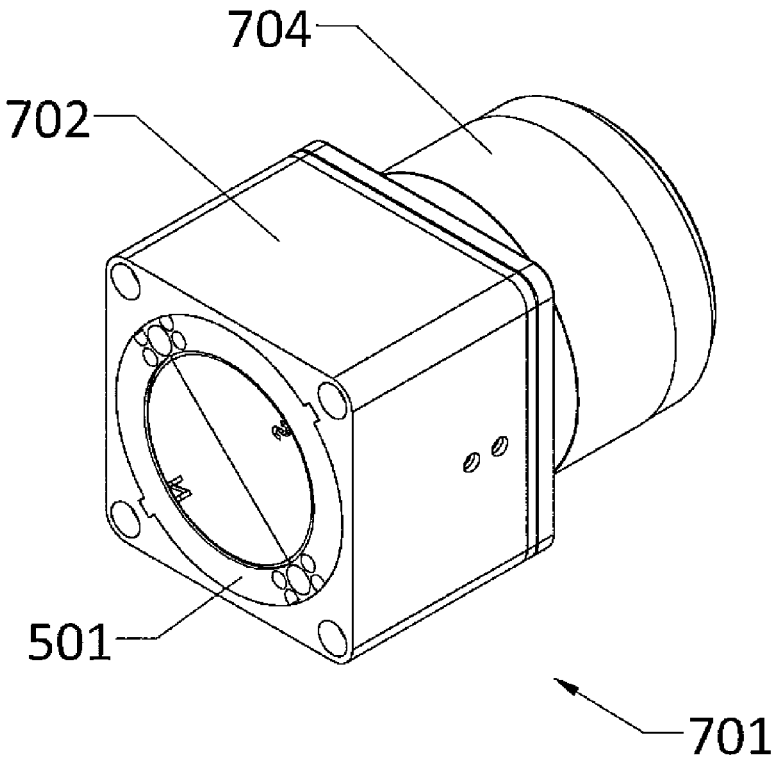
FIG. 18A is an oblique view of a mechanized actuation form of a two-carrier platter magnetic apparatus with the combination ferromagnetic lower carrier platter, integrated pole conduits and a diametrically polarized disc as depicted in FIG. 13.
Figure 18B:
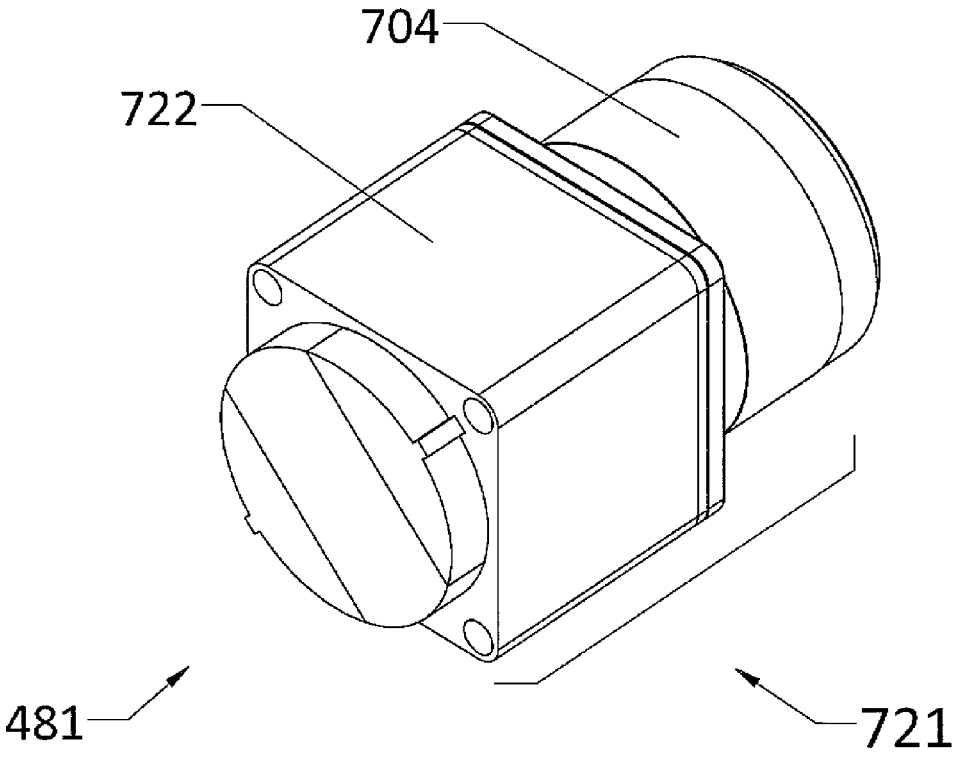
FIG. 18B is an oblique view of a mechanized actuation form of a two-carrier platter magnetic apparatus with the core element depicted in FIG. 12A.
Figure 18C:
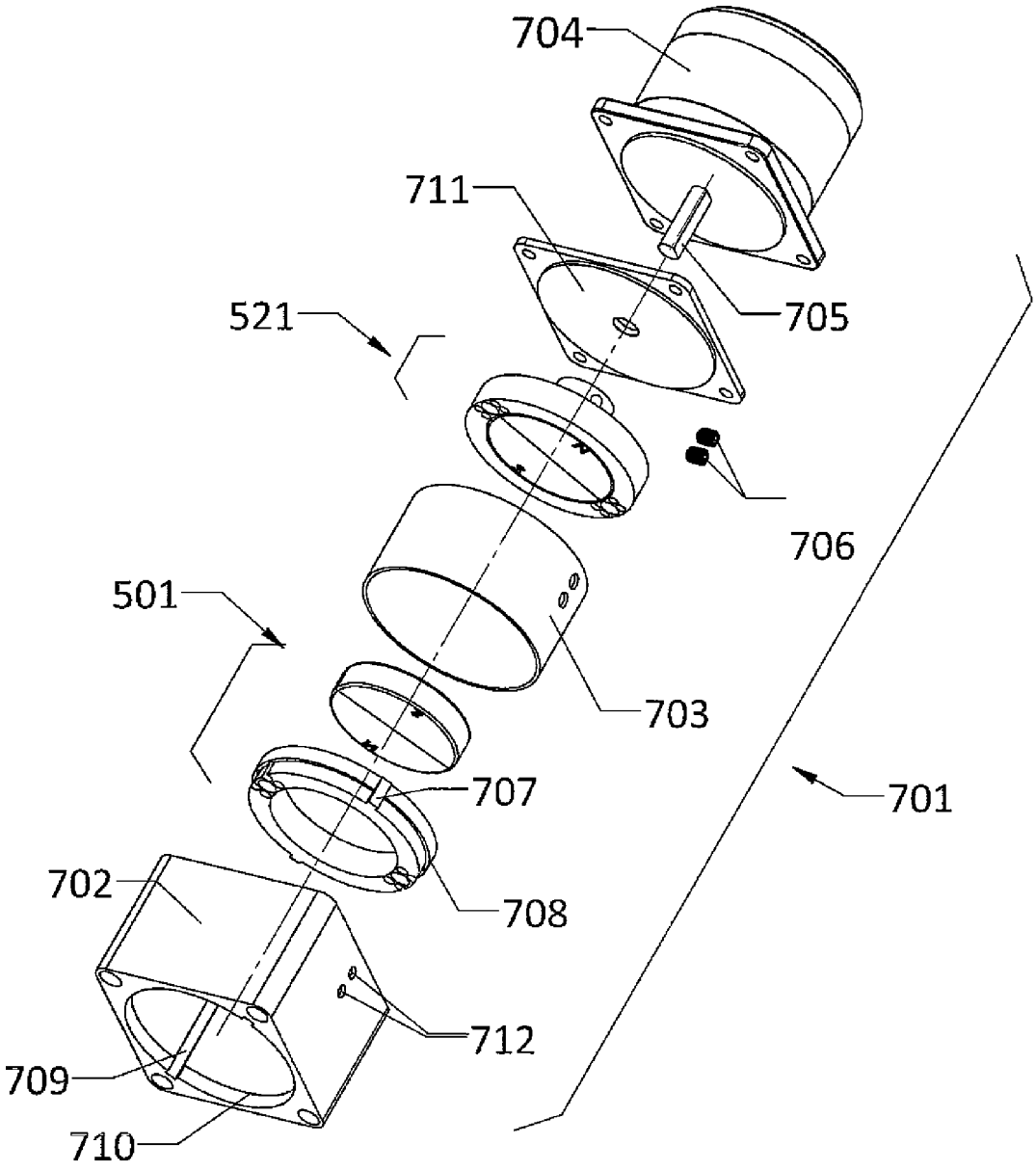
FIG. 18C is an oblique view of a mechanized actuation form of a two-carrier platter magnetic apparatus as depicted in FIG. 18A.

Use of a standard stepper motor such as NEMA 34 size allows for rapid integration and standardized mounting configurations of the apparatus. Having already selected the appropriate magnet and determined the needed pole conduit size, a core element can be specified and integrated into a carrier platter that allows for a housing that is affixed to the motor exterior and a shaft that rotates the upper carrier platter. Ideally the unit is sealed and there is no friction between the carrier platters containing the core elements. To maximize product performance optimal shaped pole conduits could be inserted into a non-ferrous carrier platter. FIGS. 18A, 18B and 18C depict such a design that allows for interchangeable carrier platters that can be readily substituted based on the desired magnetic characteristics. As there is no contact between the two carrier platters, only the motor would need to be replaced over time. Motor types can be readily interchanged for various other technologies including, for example and not by way of limitation, manual solenoid actuated, stepper motor, gear drive servo motors, pneumatic, hydraulic, linear actuated and other forms of mechanized or motorized actuators.

Relative angular displacement of the carrier platters allows core elements on each carrier platter to be aligned in-phase (N-N/S-S), out-of-phase (N-S/S-N), or in partial phase with each other. The pole conduits for each core element are to be isolated sufficiently from each other so as to avoid short-circuiting the two pole conduits together. Isolation of the north and south pole conduits is necessary to avoid magnetic field cancellation (short circuiting) due to "magnetic coupling" of opposite polarity magnetic fields contained within pole conduits in close proximity to each other.

Two or more carrier platters may be stacked on one another. Performance of the switchable core-element based permanent magnet apparatus is maximized by minimizing the gap between the carrier platters and by eliminating or reducing the air gap between the lowest carrier platter (where carrier platters are stacked on top of one another) and the target material. When stacking more than two pole carrier platters, pole contact surface area must be accounted for in relation to the magnets' pole surface area.

N-N or S-S alignment of the upper carrier platter's core element to the lower carrier platter's core element produces a repulsive force between the two carrier platters. This repulsive force between the two carrier platters diminishes when an activated switchable magnet apparatus comes into contact with a target. As the target thickness increases, the force necessary to actuate the magnetic field drops off considerably. One embodiment that allows for a lower actuation force is to allow the upper carrier platter to separate from the lower carrier platter during actuation of the magnetic field. An increased air gap will reduce the actuation force by reducing oversaturation of the target material. Target materials that are relatively thin compared to the core elements will exhibit a repulsion force greater than the attraction between the core elements.

When rotating from an anti-aligned position (deactivated) to an aligned position (activated), the magnetic field emanating from the pole conduits increases in strength relative to the rotation angle from 0° to 180°. While this force is not directly proportional to the angle, it can be defined so that a variable magnetic force can be attained by partially rotating one carrier platter with respect to the other and having detents or locking positions to hold the carrier platter position at the desired magnetic field level. Attaining this variable magnetic force may be useful when it is undesirable to have a strong residual magnet field emanating through a thinner target, or to optimize the magnetic field based on material thickness, or for test lifting to ensure adequate breakaway performance, or to reduce actuation torque required based on material saturation. Rotation of the carrier platters may be accomplished, by many different means, for example and not by way of limitation, by using a spanner, knurled wheel or surface, knob, lever, friction wheel, or the like.

Minimizing the separation between the carrier platters when aligned in an N-N configuration maximizes the attractive force on the target due to full saturation of the target. Oversaturation can be minimized by allowing the upper carrier platter(s) to separate from the lower carrier platter(s) during N-N, S-S alignment.

N-S or S-N alignment of the upper carrier platter(s) to the lower carrier platter(s) produces an attractive force between the two carrier platters. When the core elements are anti-aligned in the N-S/S-N position there is a strong attraction to each other. In this configuration, the magnetic fields cancel out each other resulting in the deactivated or de-actuated (OFF) position.

Rotation of the upper carrier platter(s) into an N-N/S-S alignment, that is in an activated or actuated mode (ON position) when not on a ferrous target results in a spring-like resistance against rotation. If the apparatus is pulled off of the target while actuated, there is an increase in the repulsive forces between the carrier platters (the same magnetic repulsion observed when no target is present) causing the carrier platter(s) to rotate back to the "OFF" position unless restrained. It is thus important that a detent or lock feature be included in the apparatus if used on variable thickness targets or if actuation off-target is desirable.

Once the switchable core-element based permanent magnet apparatus is positioned on a target that is not fully saturated, the attraction between carrier platters is relatively mild in a N-N/S-S or in the case of a four carrier platter apparatus N-N-N-N/S-S-S-S orientation. This magnetic behavior is very useful in preventing accidental actuations or assumed attachment onto a nonmagnetic or mildly ferromagnetic target material. Moreover, the resistance level observed by the operator when attempting to actuate the magnet apparatus provides the user with feedback as to the expected level of breakaway performance when the target composition or magnetic permeability is unknown. Crystalline structure, chemical composition, and/or work hardening can have a dramatic impact on the magnetic permeability of the target. The more difficult it is for the operator to actuate the apparatus, the weaker the breakaway force. This can provide the user of the apparatus with feedback as to the extent the apparatus is attracted to the target.

Depending upon the desired application, a housing configuration may be used to contain the carrier platters. The primary purpose of the housing is to contain the carrier platters while allowing the rotation of one or more of the platters. The housing may also be used as a means to provide a rotation limiting mechanism for proper alignment of the core elements. The housing may include provisions for attachment to, for example and not by way of limitation, fixtures, tools, and robotic arms.

The housing may include provisions that allow the mounting of an array of two or more magnetic core element carrier platter assemblies with either a common actuation point or individual actuation points. The housing may be configured so that two or more magnetic core element carrier platter assemblies may be mounted orthogonally (at right angles to each other).

The examples cited herein with respect to provisions to limit the rotation angle of the carrier platters are by way of example and not limitation as there are numerous methods not specifically cited that will accomplish the same desired limitation of rotation angle.

Various coating and or plating options may be used to enhance the product performance based on the intended application. As most magnetically soft steel oxidize readily, a coating or plating is often necessary to protect the apparatus from corrosion. Several coatings have been identified in that they not only offer enhanced corrosion resistance, but that they can also affect product performance in terms of shear force, breakaway strength, and electrical performance among other variables. As an example, black oxide coatings provide for an improvement in the ability for the magnetic field to conduct from adjacent core elements to each other and for the ability of the magnetic field to conduct to the work surface thereby increasing breakaway force and subsequently shear force. Titanium nitride coatings, which are often used to reduce friction on cutting tools, can actually dramatically increase the shear force performance of the apparatus, that is the force to make the apparatus slide along a target. Copper, silver, gold and other highly conductive plating materials can be used to improve electrical conductivity of the apparatus when used in electrical applications. The use of these and other coating and plating methods such as titanium nitride, black oxide, zinc plating, copper plating, nickel plating, plasma coating (by way of example and not limitation), are expected and their use is anticipated based on the desired application for the apparatus.

DETAILED DESCRIPTION OF THE DRAWINGS

This invention provides for modular magnet designs that are compact and comprised of two or more carrier platters with a matching single core element per carrier platter. The arrangement of carrier platter layers, comprised of relatively thin, matched core elements contained within each carrier platter, provides for a switchable (ON/OFF) high magnetic flux density device.

The modular holding device comprises two or more geometrically similar carrier platters of interchangeable permanent magnets and pole conduits. FIGS. 4A through 14 show several possible arrangements of magnets matched to pole conduits, for example and not by way of limitation. Some possible pole conduit shapes are depicted in FIGS. 4A, 5A, 6, 7, BA, 9, 10, 11A, 12A, 13 and 14.

Figure 4A:
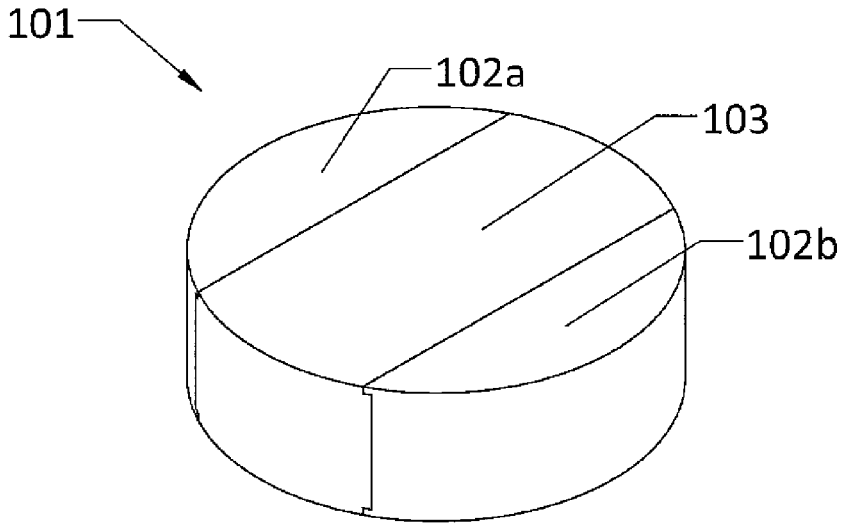
FIG. 4A is an oblique view of a single core element embodiment comprised of multiple bar-shaped permanent magnets, a non-ferromagnetic spacer/holder, and two magnetically soft steel pole conduits.
Figure 4B:
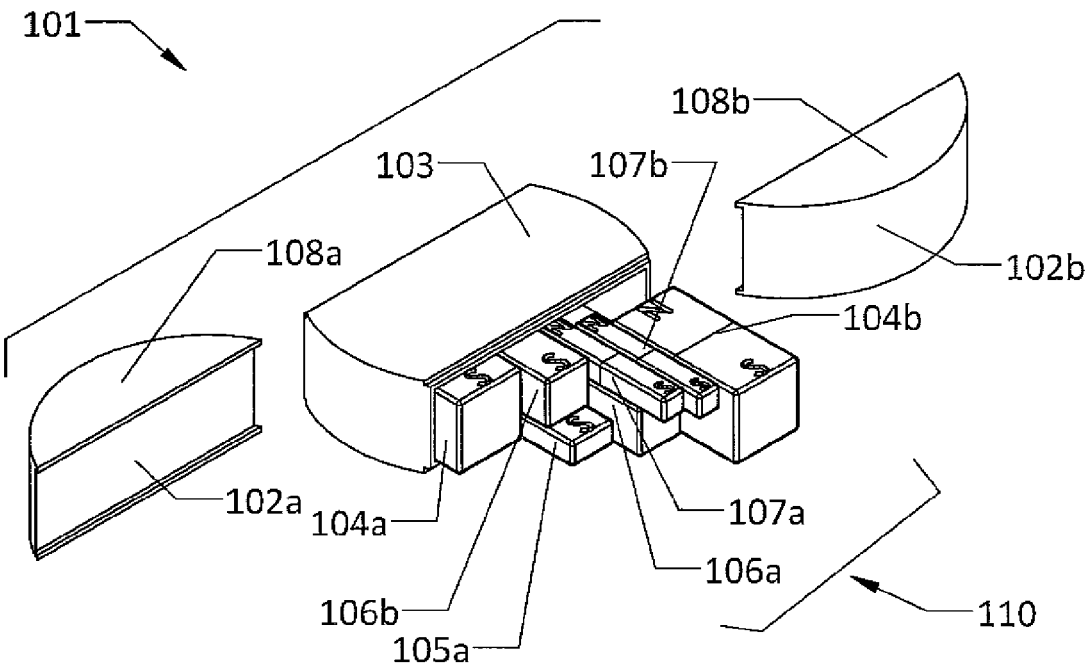
FIG. 4B is an oblique exploded view of the embodiment described by FIG. 4A.
Figure 4C:
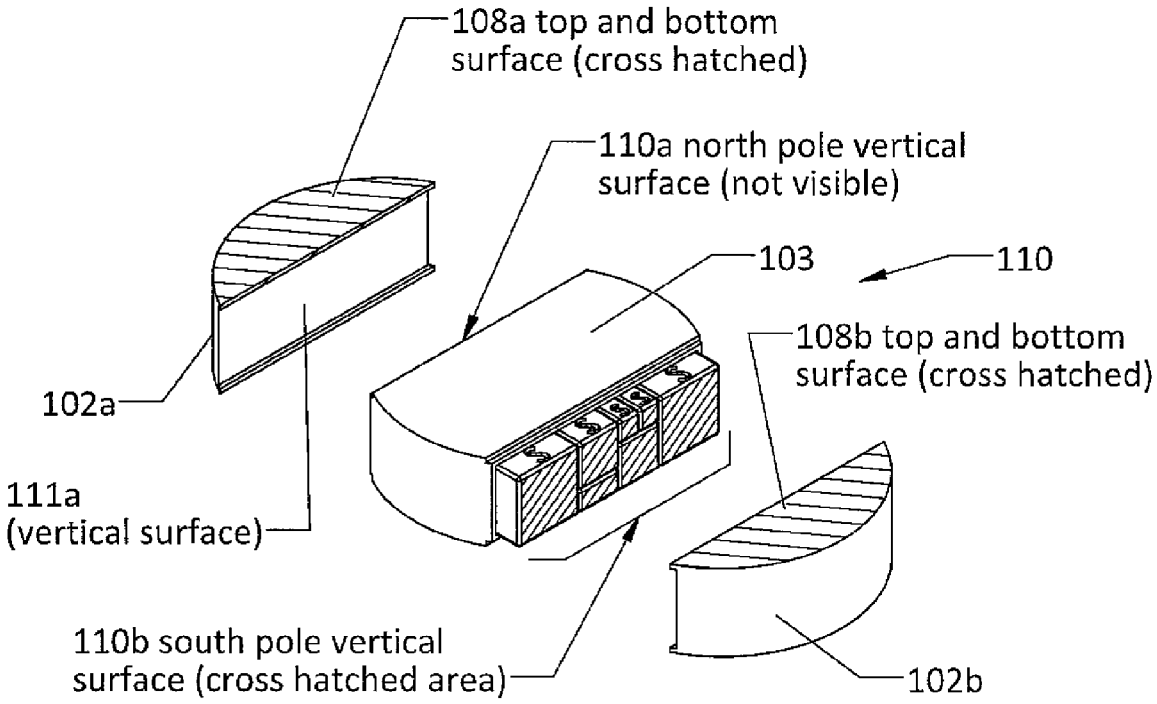
FIG. 4C is an oblique partially exploded view of the embodiment depicted in FIG. 4A.

FIGS. 4A, 4B, and 4C demonstrate the highly flexible nature of the invention's architecture. The figures depict core element 101 comprised of magnetically soft matched pole conduits 102*a* and 102*b* affixed to a multitude of permanent magnets 110 (the combination of 104*a*, 104*b*, 105*a*, 106*a*, 106*b*, 107*a* and 107*b*) that are all the same length and contained within a non-ferrous housing 103. The combined south pole faces 110*b* of the permanent magnets 104*a*, 104*b*, 105*a*, 106*a*, 106*b*, 107*a* and 107*b* are affixed to the vertical face of pole conduit 102*b* thereby defining pole conduit 102*b* as a "south pole conduit". Similarly, the combined north pole faces 110*a* of the permanent magnets 104*a*, 104*b*, 105*a*, 106*a*, 106*b*, 107*a* and 107*b* are affixed to the vertical face 111*a* of pole conduit 102*a* thereby defining pole conduit 102*a* as a "north pole conduit". The surface area 108*b* of south pole conduit 102*b* is a minimum of 75% of the permanent magnet(s) pole surface area 110*b*, defined as the "Pole Surface Ratio of the Conduit" (that is, the ratio of the pole conduit surface area to the magnet pole face surface area in a core element). When four carrier platters are used, the pole conduit surface area 108*b* must be a minimum of 75% of the sum of all surface areas of like poles in two carrier platters (that is, pole conduit 108*b* must be two times 75% the magnetic pole surface area 110*b*). In larger applications (largest magnet over 50 mm thick), substitution of a plurality of magnets with a single larger magnet, while possible, is often more costly and not as desirable. The performance of the plurality of permanent magnets, equal to the same volume, often exceeds the performance of a single larger magnet due to the magnetizing inefficiencies described earlier. Substitution of longer and/or stronger permanent magnets as depicted in FIGS. 4A-4C does not alter the Pole Surface Ratio of the Conduit.

As an example, assume that all of the magnets depicted in FIGS. 4B and 4C are 40 mm long. The pole conduit top and bottom surface area size 108*a* and 108*b* must remain the same whether the magnet length is 10 mm or 50 mm long. In most cases use of a Pole Surface Ratio of the Conduit less than 75% will often result in the magnetic field not fully deactivating. Use of a larger Pole Surface Ratio of the Conduit will decrease the magnetic depth of field, ultimately resulting in a reduced magnetic breakaway strength and less target material saturation. While the optimal Pole Surface Ratio of the Conduit is identified here as 75%, variations in permeability of the materials used for the pole conduits and magnet geometries can impact the ratio. New configurations should be verified by ensuring that out-of-phase core elements properly deactivate the pole conduits.

Figure 5A:
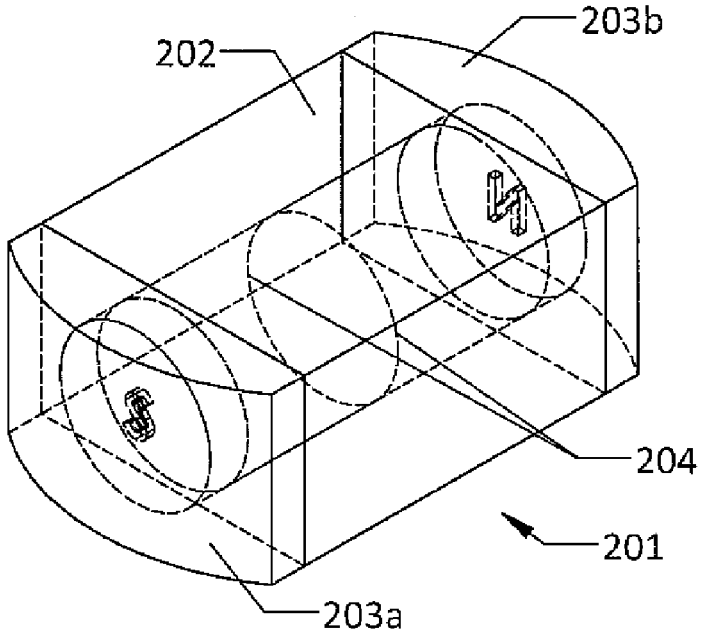
FIG. 5A is an oblique transparent view of a single core element embodiment, comprised of a single cylindrical permanent magnet, a non-ferromagnetic spacer, and two magnetically soft steel pole conduits.
Figure 5B:
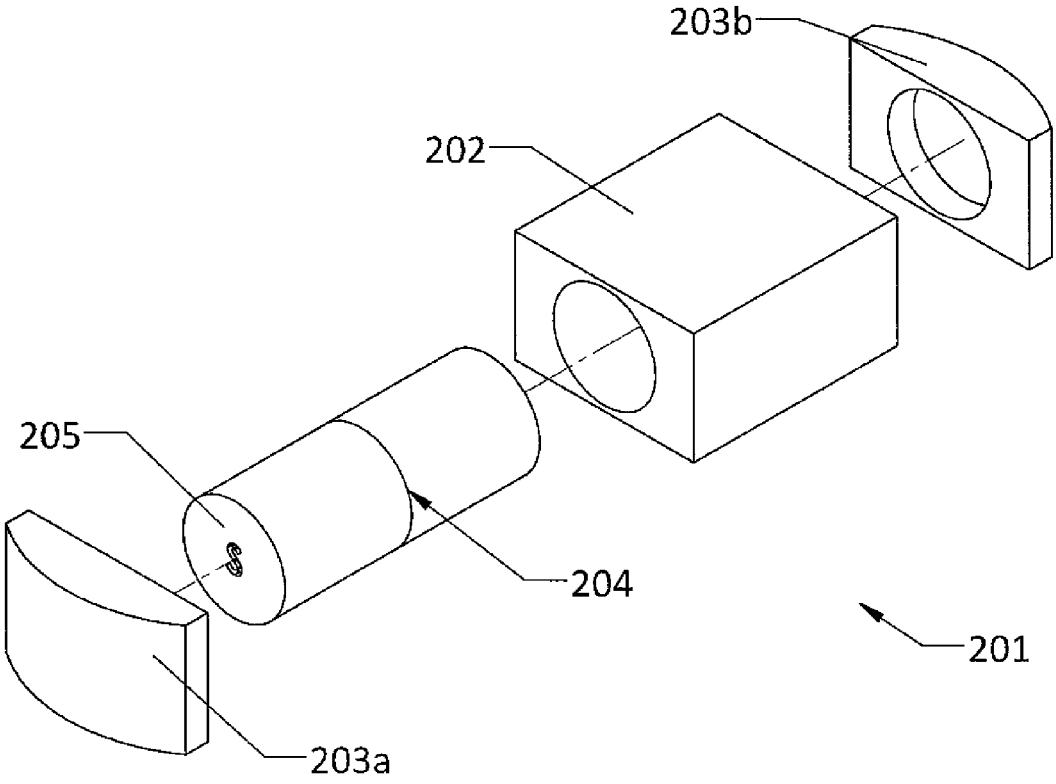
FIG. 5B is an oblique exploded view of the embodiment depicted in FIG. 5A.

FIGS. 5A and 5B demonstrate a core element 201 comprised of cylindrical magnet 204, partially inset into pole conduits 203*a* and 203*b*. Inset depth of the magnet into the pole conduit should be kept to a maximum of ⅛ the depth of the pole conduit or the magnet length. The inset is demonstrated intentionally deeper for clarity and is used to aid assembly. Substantial increases in the inset depth can have a negative impact on magnet performance. An optional nonferrous housing 202 is used to encase and protect magnet 204. The magnetic pole face 205 (one of the ends of the magnet where the magnetic field is strongest) of cylindrical magnet 204 may be placed onto the surface or partially inset into pole conduit 203*a*.

Figure 6:
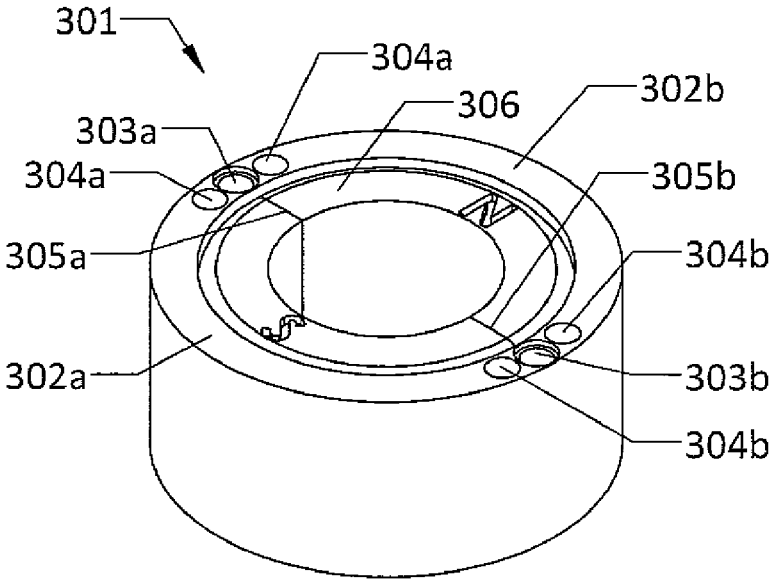
FIG. 6 is an oblique view of a single core element embodiment comprised of a single diametrically polarized, ring-shaped permanent magnet and a single tube-shaped pole conduit that has been drilled to behave as two individual pole conduits.

FIG. 6 demonstrates a tube-shaped core element 301 comprised of a diametrically polarized cylindrical ring magnet 306 and combination carrier platter/core element assembly 302*a* and 302*b*. The magnetic pole separation lines 305*a* and 305*b* are interrupted by isolation holes 303*a* and 303*b* to minimize magnetic coupling between the north magnetic field contained in pole conduit 302*b* and the south magnetic field contained in pole conduit 302*a*. Additional isolation holes 304*a* and 304*b* are used to further reduce any magnetic coupling.

Figure 7:
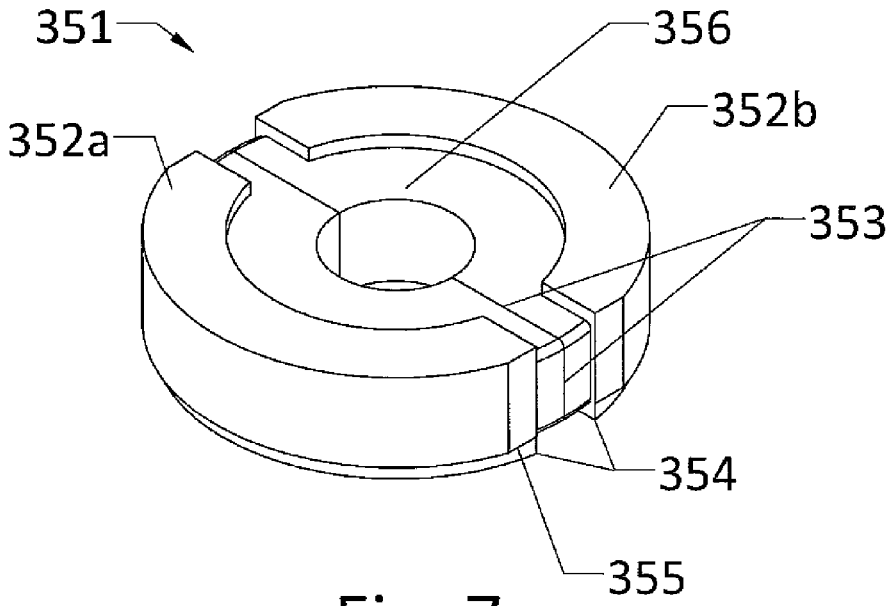
FIG. 7 is an oblique view of a single core element embodiment comprised of a single diametrically polarized disc-shaped permanent magnet and two magnetically soft steel pole conduits.

The core element 351 as shown in FIG. 7 depicts a set of pole conduits 352*a* and 352*b* affixed to a diametrically polarized magnet 356 with isolation between pole conduits 352*a* and 352*b*, oriented along magnetic pole separation line 353, accomplished by a gap as defined by 354. A machined groove 355 is incorporated into pole conduits 352*a* and 352*b* as a means of locating the core element into a larger assembly such as the one described later in FIG. 18C.

Figure 8A:
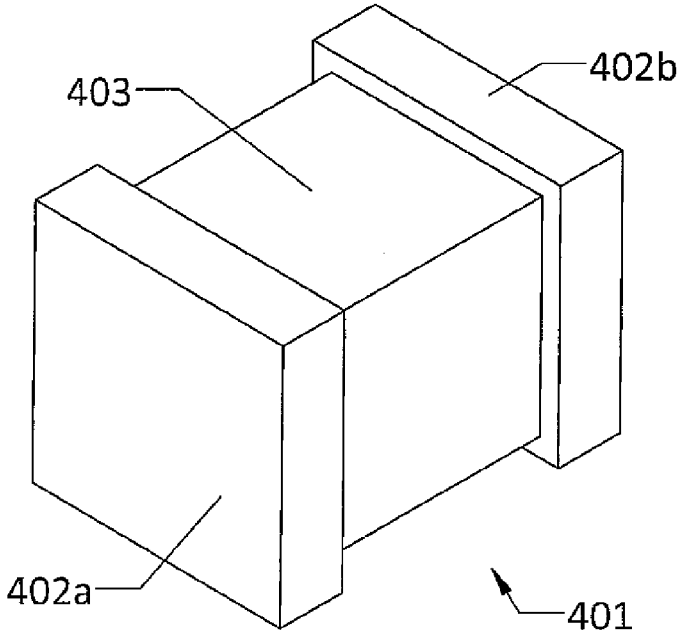
FIG. 8A is an oblique view of a single bar-shaped core element, comprised of a single cylindrical permanent magnet, a non-ferromagnetic spacer, and two magnetically soft steel pole conduits.
Figure 8B:
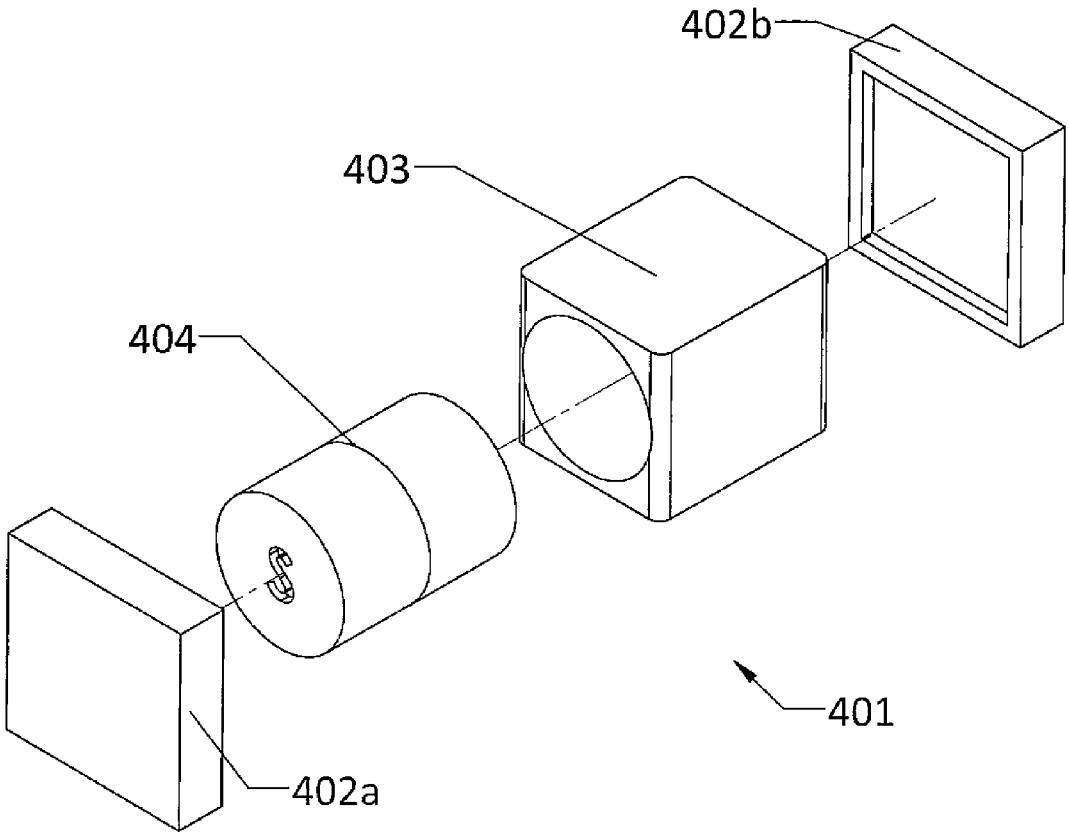
FIG. 8B is an oblique, exploded view of the embodiment depicted in FIG. 8A.

FIGS. 8A and 8B depict a core element 401 that is effectively bar-shaped. It is comprised of cylindrical magnet 404 affixed to pole conduits 402*a* and 402*b* with the cylindrical magnet encased in a protective optional nonferrous housing 403. This core element is another example of the flexible architecture of the invention in that virtually any shape of magnet may have its respective magnetic field contained and redirected into virtually any shape of pole conduit.

Figure 9:
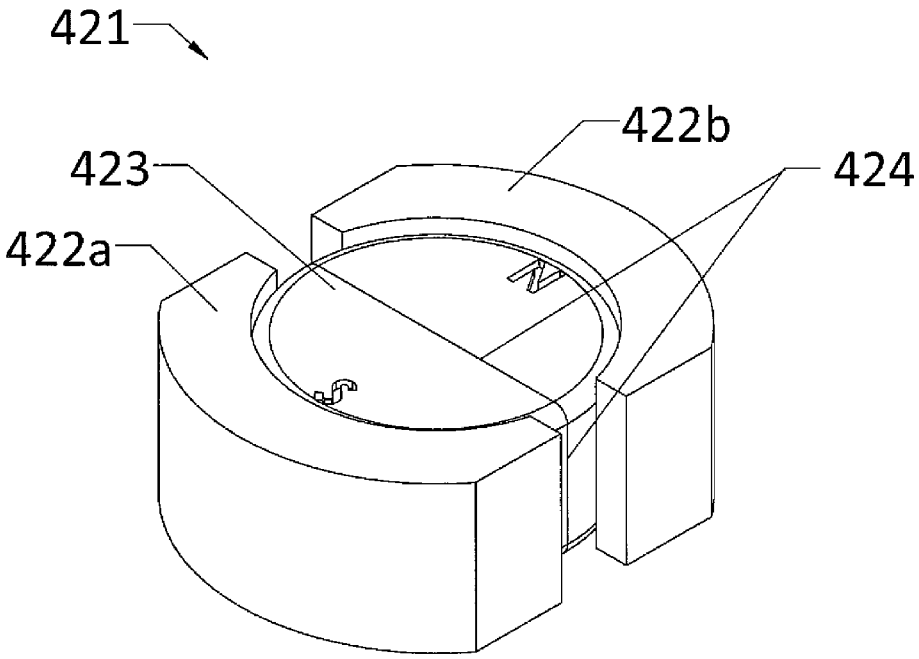
FIG. 9 is an oblique view of a single core element comprised of a single diametrically polarized disc-shaped permanent magnet affixed to two soft steel pole conduits that are semi-cylindrical in shape with a fixed gap between the pole conduits.

FIGS. 9 and 10 depict core elements 421 and 441, respectively. The embodiments show a few examples of pole conduit shapes (422*a*, 422*b*, 442*a*, and 442*b*) that may be used with just one shape of magnet 423 with magnetic pole separation line 424 isolated from the "separate" pole conduits (422*a*, 422*b*, 442*a*, and 442*b*). FIG. 10, while being a single piece housing containing both pole conduits 442*a* and 442*b*, behaves essentially the same as the embodiment shown in FIG. 9 since the material adjacent to the magnetic pole separation line 424 is very thin and incapable of providing an effective magnetic coupling between the poles.

Figure 11A:
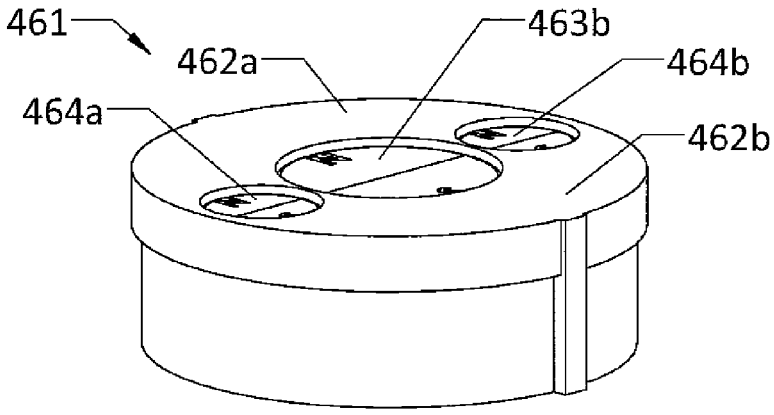
FIG. 11A is an oblique view of a single core element embodiment comprised of multiple different sized diametrically polarized disc-shaped permanent magnets affixed into a single magnetically soft carrier platter that functions as two separate steel pole conduits.
Figure 11B:
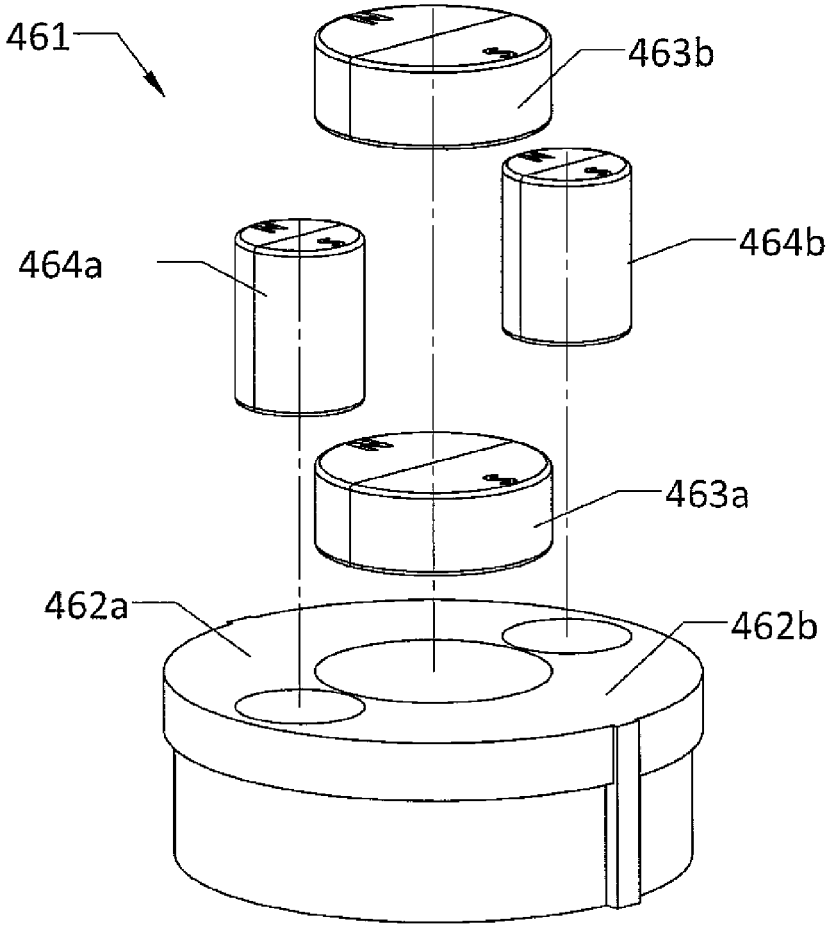
FIG. 11B is an oblique exploded view of the embodiment depicted in FIG. 11A.

FIGS. 11A and 11B depict a lower combination carrier platter/core element assembly 461 made of a single-piece of magnetically soft steel and four diametrically polarized magnets 463*a*, 463*b*, 464*a*, and 464*b*. The four permanent magnets are aligned such that the amount of ferrous material (steel) between the magnets is minimized to reduce magnetic coupling between the permanent magnets' north and south poles. This effectively creates two isolated pole conduits 462*a* and 462*b*. The combination carrier platter/core element assembly 461 reduces the assembly part count, manufacturing cost, and part complexity while optimizing the Pole Surface Ratio of the Conduit.

Figure 12A:
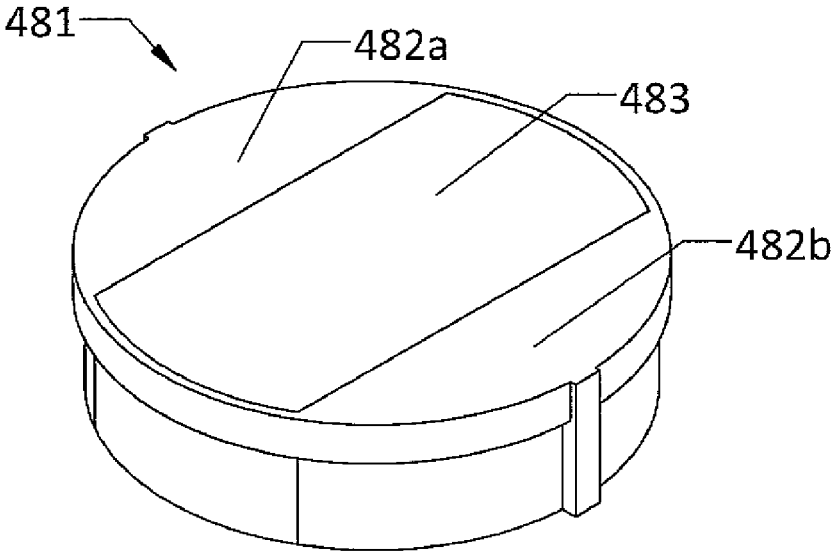
FIG. 12A is an oblique view of a single core element consisting of a combination ferromagnetic lower carrier platter that is integrated with the pole conduits and a multitude of bar-shaped permanent magnets contained within anon-ferromagnetic spacer.
Figure 12B:
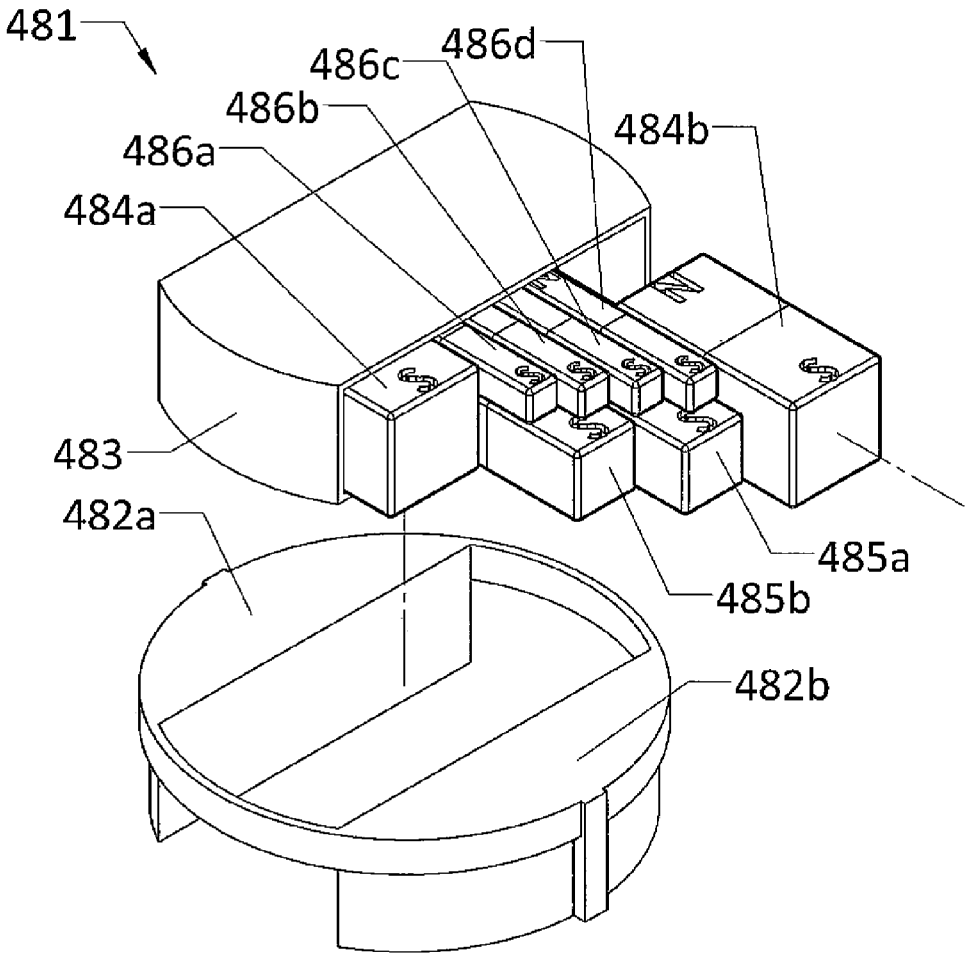
FIG. 12B is an oblique exploded view of the embodiment depicted in FIG. 12A.

FIGS. 12A and 12B depict a lower combination carrier platter/core element assembly 481 made of a single-piece magnetically soft steel and a multitude of equal length bar shaped permanent magnets of various cross sections. The bar magnets 484*a*, 484*b*, 485*a*, 485*b*, 486*a*, 486*b*, 486*c*, and 486*d* are all oriented in the same polar direction such that all of the permanent magnet south poles contact one inside face of the combination carrier platter/pole conduit and all of the permanent magnets' north poles contact the other inside face. Isolation between the pole conduits 482*a* and 482*b* is accomplished by designing in a thin wall between pole conduits 482*a* and 482*b*. Spacer 483 is used to house the permanent magnets for ease of assembly and to provide a smooth top and bottom surface (reduced friction) for the combination carrier platter/core element assembly.

Figure 13:
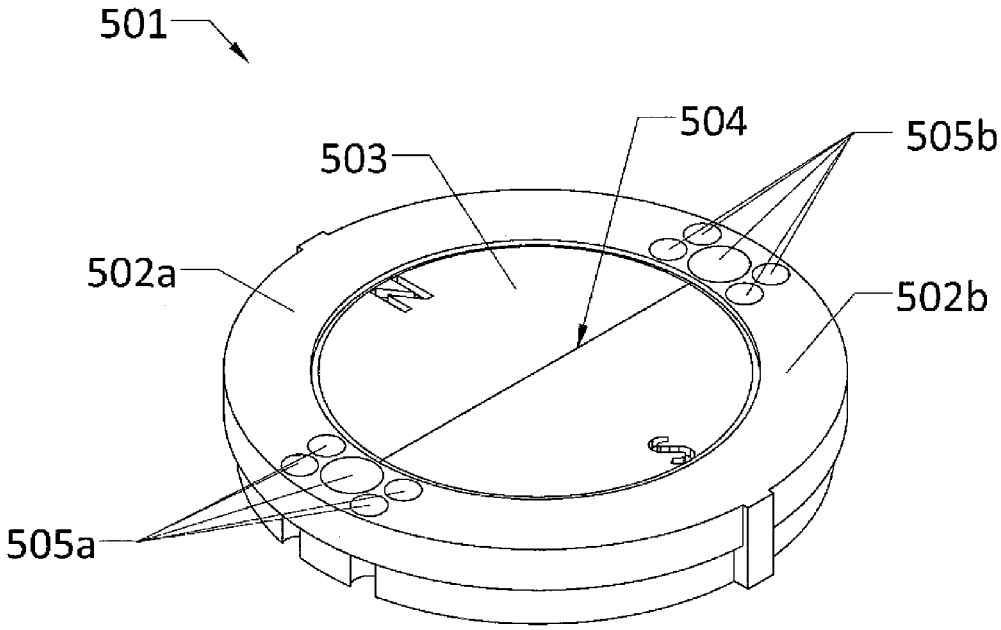
FIG. 13 is an oblique view of a single core element consisting of a combination ferromagnetic lower carrier platter that is integrated with the pole conduits and a diametrically polarized disc magnet.

FIG. 13 shows a lower combination carrier platter/core element assembly 501 made of a single-piece of magnetically soft steel and diametrically polarized magnet 503. The magnetic pole separation line 504 is aligned with isolation holes 505*a* and 505*b*. Pole conduits 502*a* and 502*b* are isolated from each other by removal of a sufficient amount of material between them. In this case the addition of a number of holes 505*a* and 505*b* are sufficient to prevent substantial magnetic coupling between the pole conduits. The combination carrier platter/core element assembly 501 reduces the assembly part count, manufacturing cost, and part complexity while maximizing the contact surface area of the pole conduits to the target.

Figure 14:
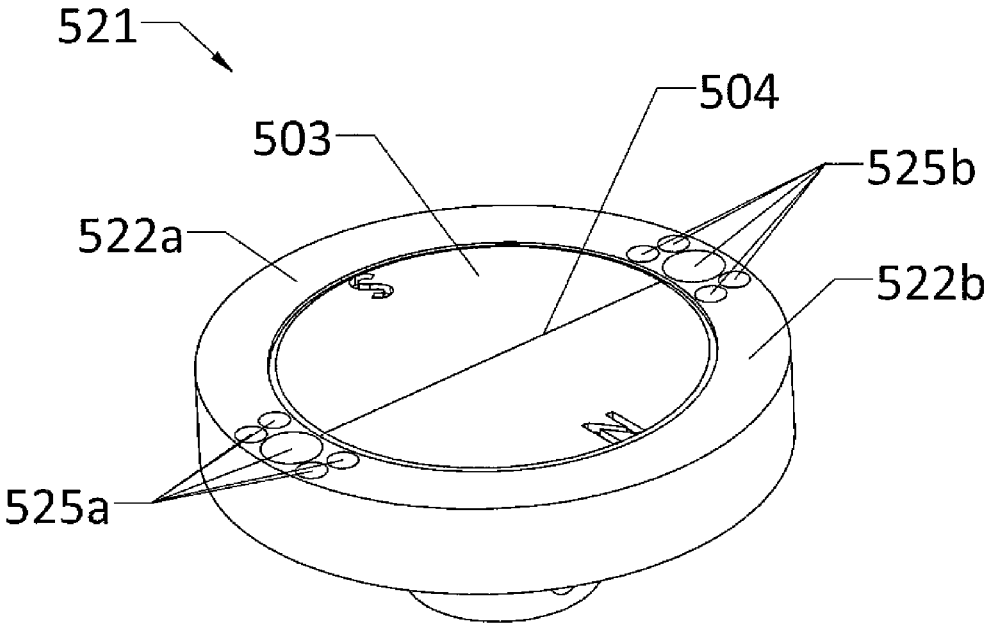
FIG. 14 is an oblique view of a single core element consisting of a combination ferromagnetic upper carrier platter that is integrated with the pole conduits and a diametrically polarized disc magnet.

FIG. 14 shows an upper combination carrier platter/core element assemblies 521 made of single-piece magnetically soft steel and a diametrically polarized magnet 503. The magnetic pole separation line 504 is aligned with the isolation holes 525*a* and 525*b*. Pole conduits 522*a* and 522*b* are isolated from each other by removal of a sufficient amount of material between them. In this case the addition of a number of holes 525*a* and 525*b* is sufficient to prevent substantial magnetic coupling between the pole conduits. The combination carrier platter/core element assembly 521 reduces the assembly part count, manufacturing cost and part complexity while maximizing the contact surface area of the pole conduits to the target.

Figure 15A:
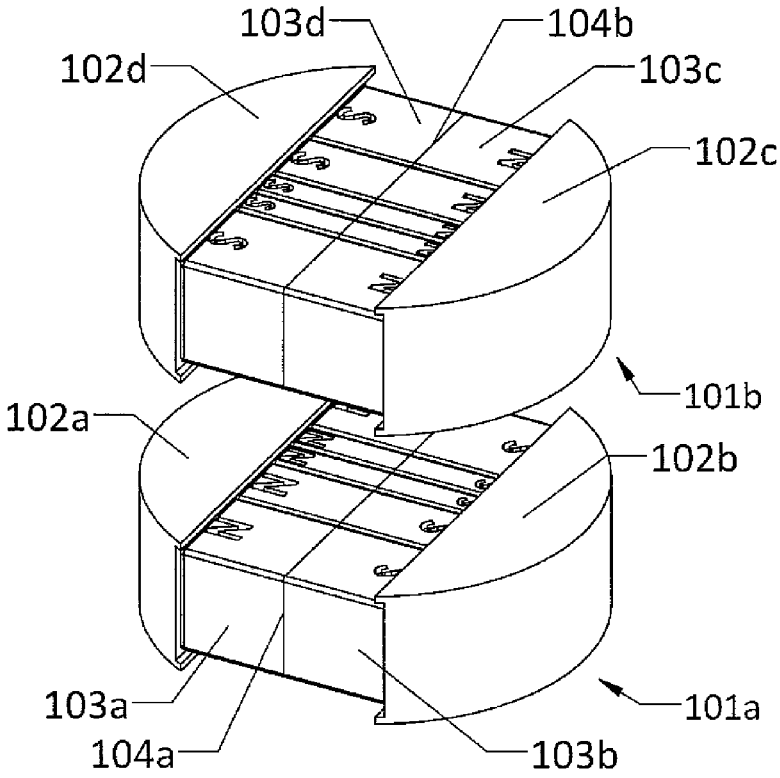
FIG. 15A is an oblique view of a stacked (separated for clarity) pair of multiple permanent magnet core elements, anti-aligned or out-of-phase.
Figure 15B:
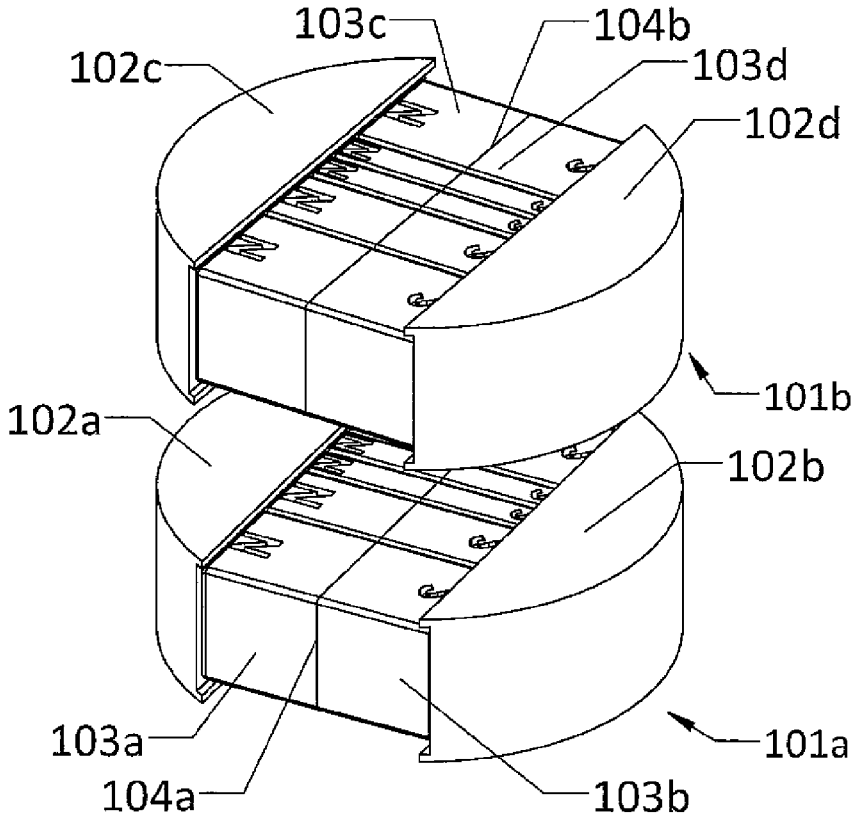
FIG. 15B is an oblique view of a stacked (separated for clarity) pair of multiple permanent magnet core elements, aligned in-phase.

FIGS. 15A and 15B are a generic representation of any two core elements 101*a* and 101*b* aligned out-of-phase and in-phase, respectively. Pole conduit shapes 102*a*, 102*b*, 102*c*, and 102*d* are only one representation of the many different shapes that may be used. There are few physical constraints on the pole conduit shapes. Ideally, the pole conduit covers the magnetic field-face of the magnet for protection, though only the height of the pole conduit face is critical in order for the pole conduit face to be at or above the permanent magnet surface. The core element pole conduits redirect the permanent magnets' north poles 103*a* and 103*c* and south poles 103*b* and 103*d* magnetic fields into the adjacent core elements' pole conduits directly above and/or below. Elimination of ferrous material between pole conduits 102*a* and 102*b* (as well as 102*c* and 102*d*) along magnetic pole separation line 104*a* (and 104*b*) is critical.

Figure 15C:
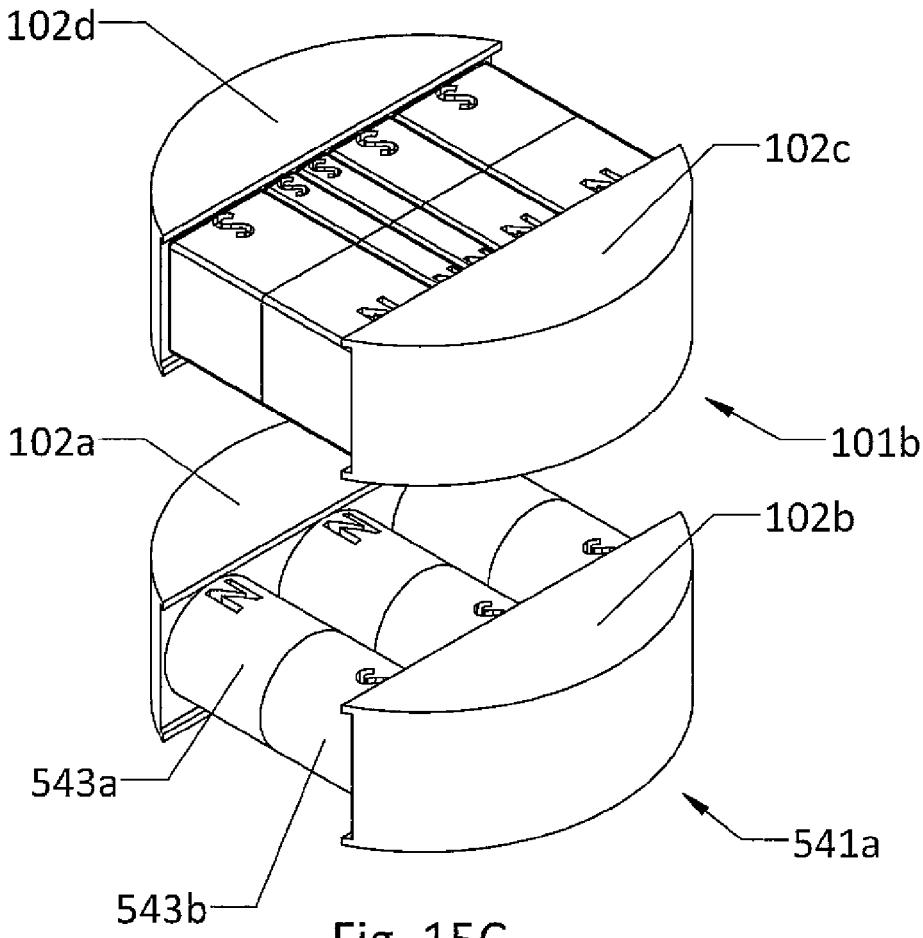
FIG. 15C is an oblique view of a stacked (separated for clarity) pair of multiple permanent magnet core elements, the upper and lower core elements using different magnet configurations and anti-aligned or out-of-phase.

FIG. 15C depicts a deactivated or out-of-phase combination of different core elements 101*b* and 541*a* that have similar pole conduits 102*a*, 102*b*, 102*c* and 102*d* but a substantially different magnet configuration between the core elements. Core element 101*b* is made up of a multitude of rectangular permanent magnets (as described earlier in FIG. 4B) and core element 541*a* is made of a multitude of cylindrical magnets which have their north poles 543*a* oriented towards pole conduit 102*a* and their south poles 543*b* oriented towards pole conduit 102*b*. As the volume of permanent magnet material is larger with the rectangular magnets than with the cylindrical magnets, core element 101*b* is expected to have a stronger magnetic field emanating from its pole conduits 102*c* and 102*d*, than core element 541*a* will have with its pole conduits 102*a* and 102*b*. Configurations such as this may be used to more adequately cancel the magnetic field emanating from the lower core elements' 541*a* pole conduits 102*a* and 102*b* at the expense of a stronger residual magnet field emanating from the upper core elements pole conduits 102*c* and 102*d* when deactivated. This configuration may be used to overcome inadequate magnetic coupling between adjacent core elements which may be caused, for example, by an excessive air gap when using thicker PTFE disks in order to attain the desired number of life cycles, non-optimal pole conduit shapes, or excess air gap between the permanent magnet(s) and the pole conduits. These factors often impact the magnetic coupling between the adjacent pole conduits enough so that the out-of-phase magnetic coupling is insufficient to completely neutralize the magnetic field emanating from the adjacent pole conduits. By using a stronger core element 101*b* a complete neutralization or even slight reversal of the magnetic field emanating from the pole conduits in the lower core element 541*a* can be achieved.

Isolation of the residual magnetic field in the upper core element when deactivated can be achieved if it is required through a variety of methods, including encasing the upper core element 101*b* with a non magnetic material of sufficient thickness or by further adding an optional magnetically soft material around a thinner non magnetic casing.

Figure 15D:
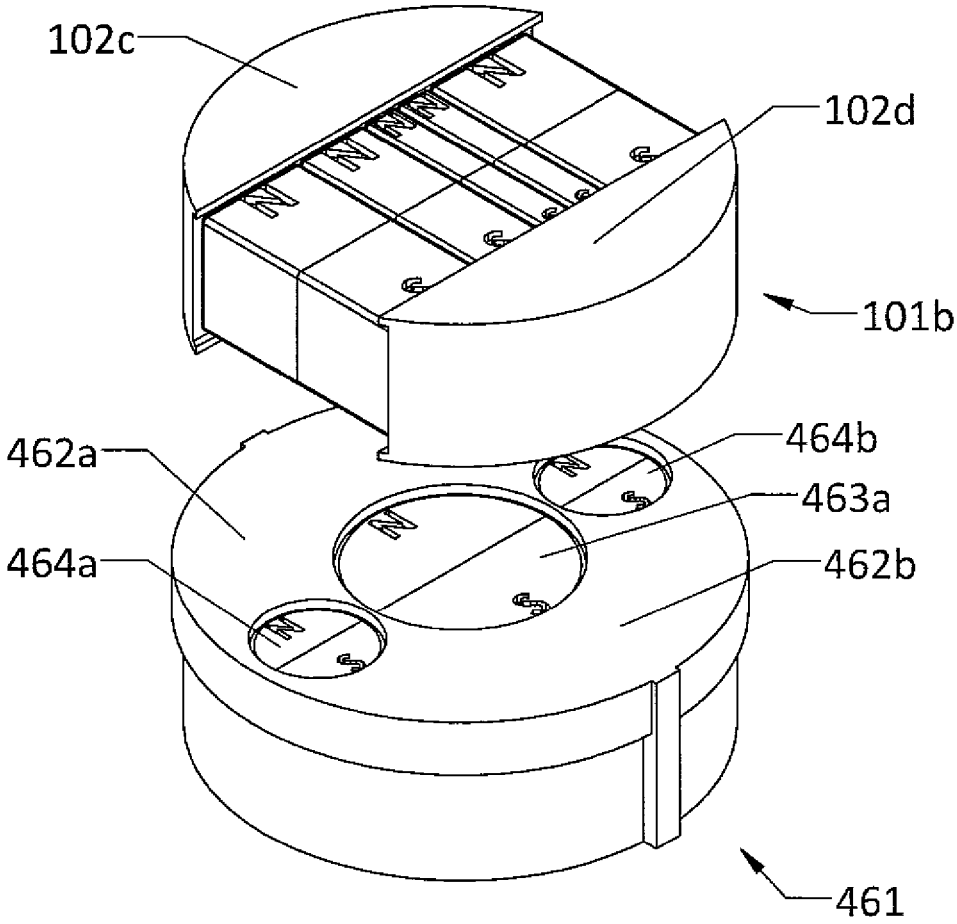
FIG. 15D is an oblique view of a stacked (separated for clarity) pair of multiple permanent magnet core elements, the upper and lower core elements being different in both permanent magnet and pole conduit shape configurations, aligned in-phase.

FIG. 15D depicts an activated or in-phase combination of substantially different core elements 101*b* and combination core element/carrier platter 461. In this instance core element 101*b* is made up of a multitude of rectangular permanent magnets (as described earlier in FIG. 4B) and core element 461 is made of a multitude of different size diametrically polarized cylindrical magnets 463*a*, 464*a* and 464*b* all oriented so that their north poles face pole conduit 462*a* and their south poles face pole conduit 462*b*. As the volume of permanent magnet material is larger with the rectangular magnets than with the cylindrical magnets, core element 101*b* is expected to have a stronger magnetic field emanating from its pole conduits 102*c* and 102*d* than core element 461 will have with its pole conduits 462*a* and 462*b*. Configurations such as this may be used to more adequately cancel the magnetic field emanating from the lower core elements' 461 pole conduits 462*a* and 462*b* at the expense of a stronger residual magnet field emanating from the upper core elements pole conduits 102*c* and 102*d* when deactivated. The lower core element, in this case, is designed to experience considerably higher forces (exerted upon it) as it comes into contact with the target than the upper core element, which is used only for the purpose of activating and deactivating the apparatus. This configuration may be used to overcome inadequate magnetic coupling between adjacent core elements which may be caused by multiple factors such as an excessive air gap when using thicker PTFE disks in order to attain the desired number of life cycles, non-optimal pole conduit shapes, or excess air gap between the permanent magnet(s) and the pole conduits. These factors impact the magnetic coupling between the adjacent pole conduits enough so that the out-of-phase magnetic coupling of identical core elements is insufficient to completely neutralize the magnetic field emanating from the adjacent pole conduits. By using a stronger core element 101*b* a complete neutralization or even slight reversal of the magnetic field emanating from the pole conduits 462*a* and 462*b* in the lower core element/carrier platter 461 can be achieved.

FIGS. 16A, 16B, and 16C show another embodiment featuring a combination shaft/base 603 attached to the combination carrier platter/core elements 301*a*. A low friction PTFE spacer 611 is placed between the upper and lower combination carrier platter/core element assemblies 301*a* and 301*b*. Core element assembly 301*a* is comprised of a cylindrical magnetically soft steel housing 302*a* and a diametrically polarized ring shaped permanent magnet 305*a*. Core element assembly 301*b* is comprised of a cylindrical magnetically soft steel housing 302*b* and a diametrically polarized ring shaped permanent magnet 305*b*. Non-ferromagnetic inserts 612 are placed into outer isolation holes 304*a* and 304*b* to provide a smooth rolling surface for the non-ferrous spring-loaded ball plungers 602*a* and 602*b* that are inserted into center isolation holes 303*a* and 303*b*. The combination shaft/base 603 has a standard thread 607 (or attachment feature) on top for mounting various accessories including threaded shafts for dial indicators or eye hooks for lifting. A multifunction rotating handle 605 is attached to the combination carrier platter/core element assembly 301*b*. The handle contains within it a means to provide a low friction, self-centering sleeve bearing 605 between magnet 305*b* and the combination shaft/base 603. Contained within the underside of the handle is a recess 609 that functions as a rotation limiter when pin 606 is inserted into the combination shaft base 603. The cutout allows the upper carrier platter to rotate approximately 180°. When the handle 605 is at the clockwise travel limit the core elements/carrier platters 301*b* and 301*a* are in a N-N/S-S in-phase alignment (ON). Rotating the handle 605 in a counterclockwise direction to the opposite travel limit aligns the core elements/carrier platters 301*b* and 301*a* in a N-S/S-N out-of-phase alignment (OFF). In cases where the target thickness of the material being attached is not thick enough to absorb the magnetic field (oversaturated), the upper core element/carrier platter 301*b* will tend to "spring back" into the OFF position. One of many such means of preventing an undesired deactivation due to this spring back force is to use one or two spring-loaded ball plungers 602*a* and 602*b*. The spring-loaded ball plungers provide for a positive locating feature in-phase and out-of-phase.

Figure 17A:
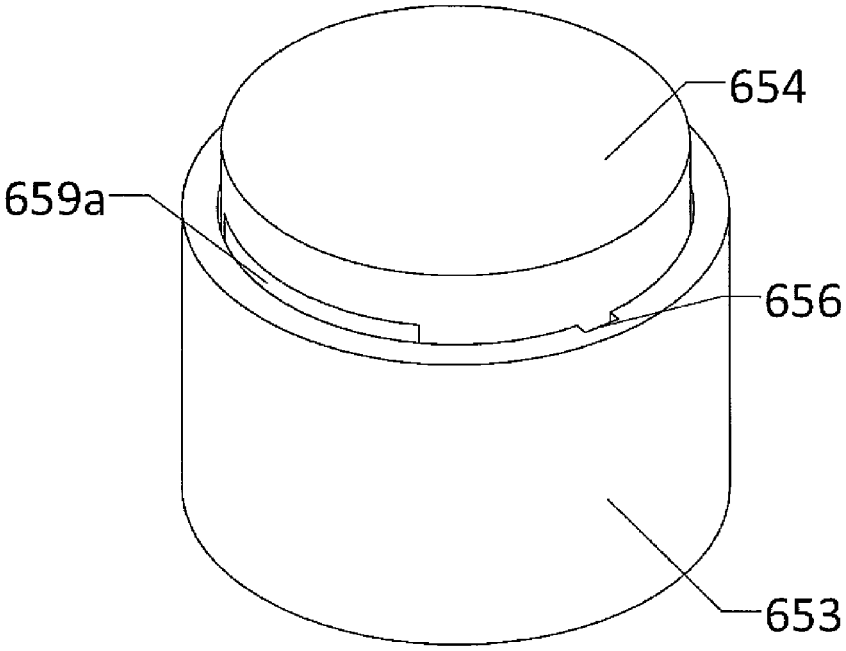
FIG. 17A is an oblique view of a top-actuated, reduced force, cylindrical core element embodiment.
Figure 17B:
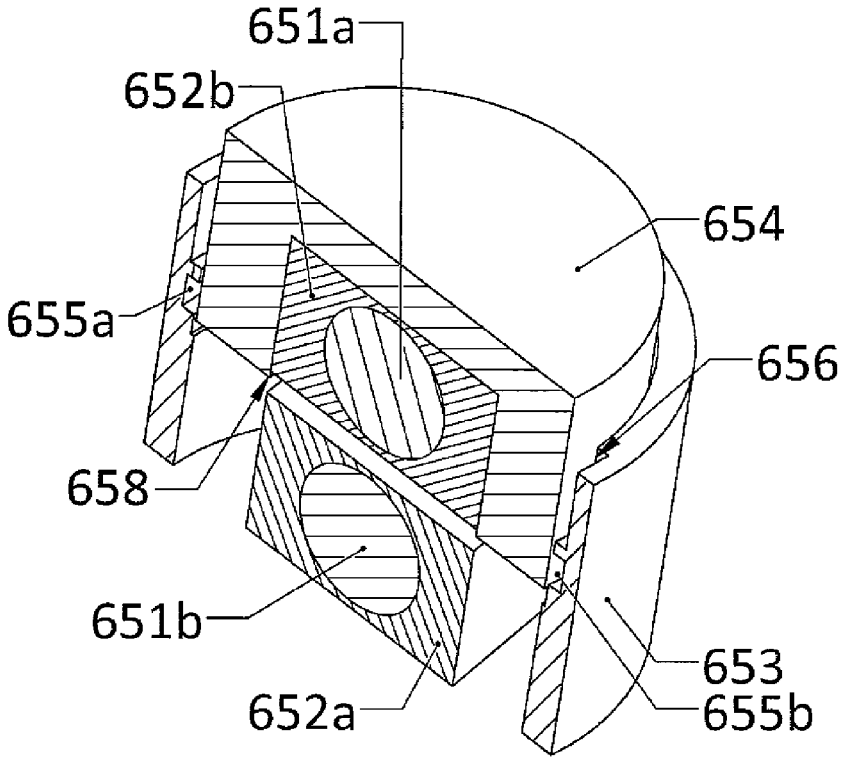
FIG. 17B is an oblique sectioned view of the embodiment depicted in FIG. 17A.
Figure 17C:
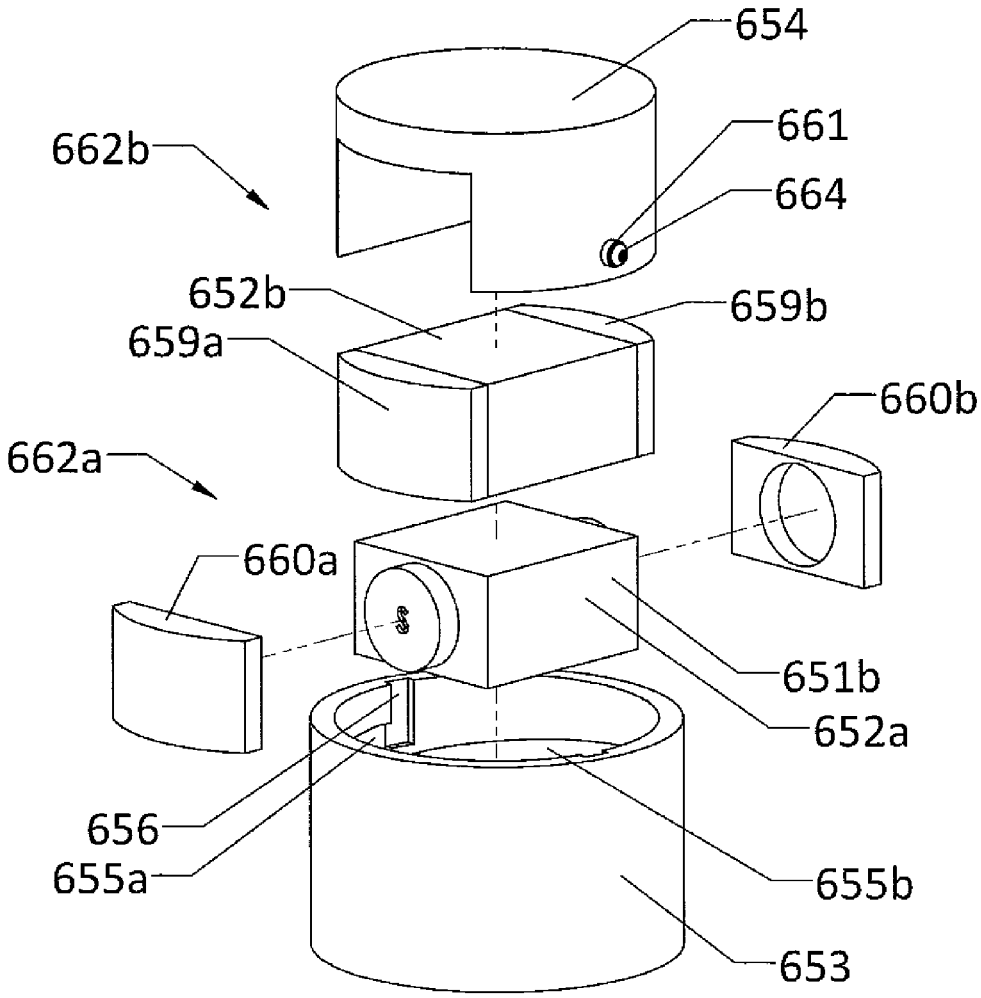
FIG. 17C is an oblique exploded view of the embodiment depicted in FIG. 17A.

FIGS. 17A, 17B and 17C show another embodiment with a reduced actuation force and variable flux magnetic field to minimize oversaturation. The embodiment has a rotating upper carrier platter 654 and a lower combination non-ferrous carrier platter/housing 653. A rectangular shaped housing with side mounting holes for attachment may be substituted for the cylindrical lower combination carrier platter/housing 653. The upper carrier platter follows a helical guide path 655*a* and 655*b* incorporated in the inner diameter of the lower combination carrier platter/housing 653. This feature allows for a vertical separation 658 between the upper core element 662*b* and the lower core element 662*a* when rotating the upper carrier platter 654 from the OFF position (0°) to the ON position) (180°. To reduce friction, bearings 661 are affixed to the upper carrier platter by screws 664. At the end of the 180° rotation, the upper carrier platter 654 is allowed to float in vertical channels 656 at the end of the helical path (0° or 180°). By allowing the upper carrier platter to float as needed on an oversaturated target, an air gap is introduced between core elements 662*b* and 662*a*. This air gap substantially reduces the magnetic field being transferred through the lower pole conduits into the target. This flotation method can reduce the magnetic flux level to substantially that of a single carrier platter. As an added benefit, by allowing the upper core element 662*b* to move away from the lower core element

662*a* during rotation, the actuation force required is substantially decreased due to the increasing air gap as the N-N pole conduits (659*b* and 660*b*) and the S-S pole conduits (659*a* and 660*a*) move into phase alignment. The reduced actuation force means that a lower cost and/or smaller motor/solenoid (or other mechanical rotation method) can be used for automated activation and deactivation of the magnetic device. In the embodiment shown, a clockwise rotation can continue with each successive stopping point (that is the point at which adjacent core elements 662*a* and 662*b* are aligned either in-phase or out-of-phase) being a reversal of the activation and deactivation of the magnetic field. As with all of the core elements depicted thus far, substitution of one or more permanent magnets having different shapes and sizes in place of permanent magnets 651*a* and 651*b* is readily accomplished. Optional magnet holders 652*a* and 652*b* are used to contain the permanent magnet(s) while providing protection, accurate locating and mounting capability into the carrier platters 654 and 653.

The embodiments shown in FIGS. 18A, 18B, and 18C, use a motorized actuator 704. The motorized actuator may be based on current or future electrical technology (stepper motor, servo motor, AC or DC gear motor, rotary and linear solenoids, among others), pneumatic, hydraulic, or other automated forms of actuating the magnetic apparatus. FIG. 18A shows lower and upper combination carrier platter/core element assemblies 501 and 521, respectively, as described earlier in FIGS. 13 and 14. FIG. 18B depicts apparatus 721 using one of many possible alternative housings and lower combination carrier platter/core element assembly 481 as described in FIG. 12A inset into housing 722 and driven by motorized actuator 704. The shape of motorized actuator 704 and housing 702 can be changed depending on the actuation technology used to rotate any combination of carrier platter(s) with respect to an affixed combination of magnetically equivalent carrier platter(s).

FIG. 18C is a partially exploded, oblique view of embodiment 701 described above. It is comprised of a nonferrous housing 702, a lower combination carrier platter/core element assembly 501, a nonferrous sleeve spacer 703, an upper combination carrier platter/core element assembly 521 an optional locating lid 711 and a motorized actuator 704. The upper combination core element/carrier platter assembly 521 is affixed to the motor shaft 705 using set screws 706. A nonferrous sleeve spacer 703 is sized to set a predetermined gap between the upper and lower combination carrier platter/core element assemblies 521 and 501, respectively. Holes 712 allow for access to tighten the set screws 706 to affix the upper combination carrier platter/core element assembly 521 at the correct location on the shaft. The lower combination carrier platter/core element assembly 501 has locating tabs 707 and a seating ring 708 which correspond to a locating recess 709 and seating shelf 710 within housing 702.

Configuration of the carrier platter and core elements used depend on the end user's desired criteria such as target weight, shape, thickness, flexibility, actuation force (strength of the motor), and product cost. In this embodiment, a few representations of core element/carrier platter assemblies 501, 521, and 481 are shown. As with the wide range of possible core element configurations, the use of many variations of core elements in standardized carrier platters are possible. It is the intention of this embodiment to provide a wide range of carrier platter assemblies that may be readily swapped and reconfigured by the end user for different applications. Rotational stops are integral to the motor system. A physical hard stop similar to the system shown in FIG. 16C or 17C may be added if the rotational motor does not have internal provisions for rotational limitation.

Figure 19A:
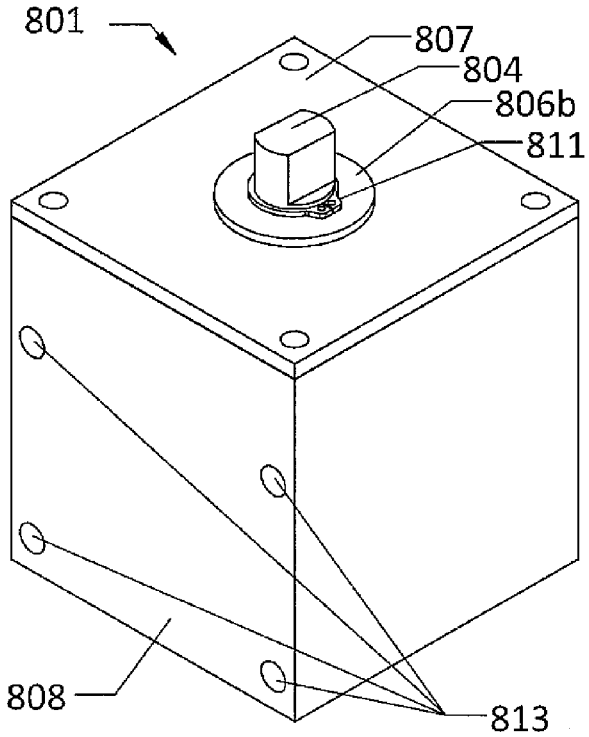
FIG. 19A is an oblique view of a four-carrier platter, disc-based core elements, deep field apparatus that is spanner or shaft actuated.
Figure 19B:
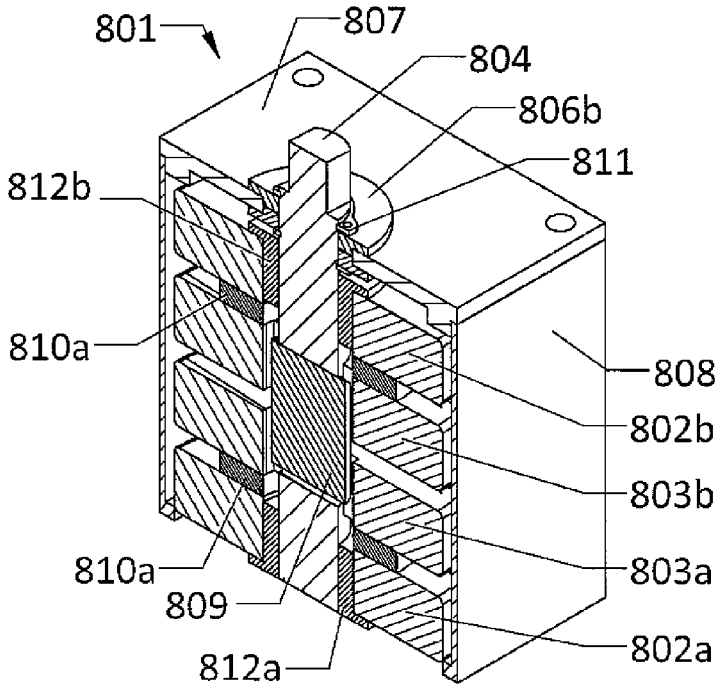
FIG. 19B is an oblique, sectioned view of the embodiment depicted in FIG. 19A.
Figure 19C:
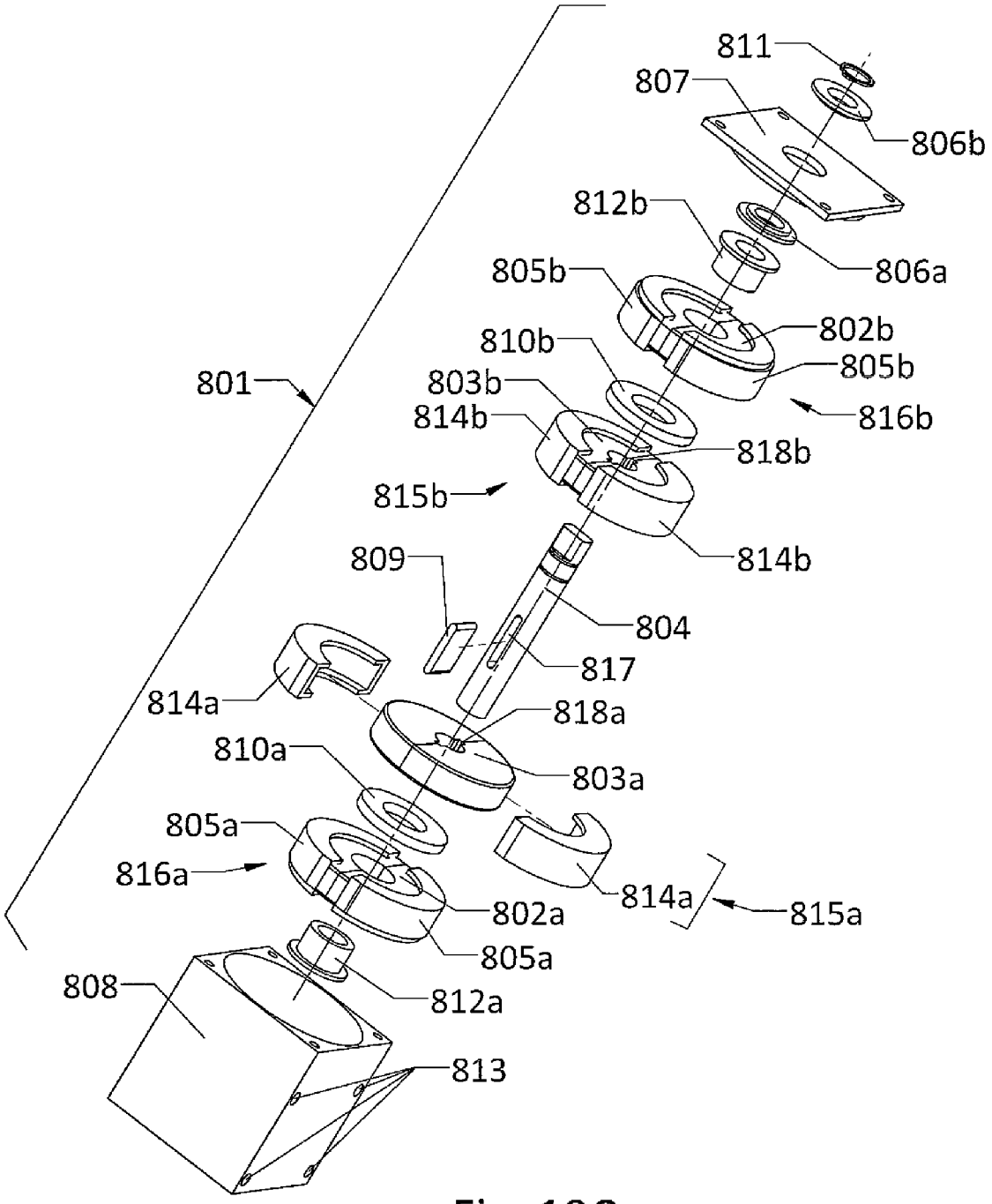
FIG. 19C is an oblique, exploded view of the embodiment depicted in FIG. 19A.

Another embodiment 801 is shown in FIGS. 19A, 19B, and 19C. This embodiment shows a multi-carrier platter arrangement contained within a housing that may be actuated by a spanner or other device at the top of the shaft 804. The carrier platter assemblies are also core element assemblies similar to the core element describe in FIG. 7. They are comprised of diametrically polarized magnets 802*a*, 802*b*, 803*a* and 803*b* with matched pole conduits 805*a*, 805*b*, 814*a* and 814*b*, respectively. Shaft 804 rotates the inner core element/carrier platter assemblies 815*a* and 815*b*. To reduce friction, the use of polymer-based sleeve bearings 812*a* and 812*b* are indicated between shaft 804 and fixed core element/carrier platter assemblies 816*a* and 816*b*. In the case of applications requiring a high number of actuations (100,000 or more cycles), ball or roller bearings may be substituted.

Embodiment 801 is further comprised of a ferrous or nonferrous housing 808 with mounting holes 813 for attachment to fixtures or other mounting devices; PTFE discs 810*a* and 810*b* provide accurate low friction gaps between the moveable middle carrier platter assemblies 815*a* and 815*b* and the fixed outer carrier platter assemblies 816*a* and 816*b*; locating key 809 fits into slot 817 in shaft 804 and accurately locates inner carrier platters 815*a* and 815*b* through keyed shaft holes 818*a* and 818*b*; rotational shaft 804 is affixed to the top lid 807 using shaft clip 811; low friction washers 806*a* and 806*b* are placed under clip 811 to reduce rotational friction further; and housing 808 has a retention feature (not shown) in the bottom of the housing and in the underside of lid 807 to orient the lower carrier platter assembly 816*a* with the upper carrier platter assembly 816*b*.

By using four core elements/carrier platters 815*a* 815*b* 816*a* and 816*b*, the magnetic field depth is increased substantially. Using multiple carrier platters that contain thinner magnets improves the magnetic flux density as compared with using core elements that are twice as thick due to the inefficiency of magnetizing larger magnets.

Figure 19D:
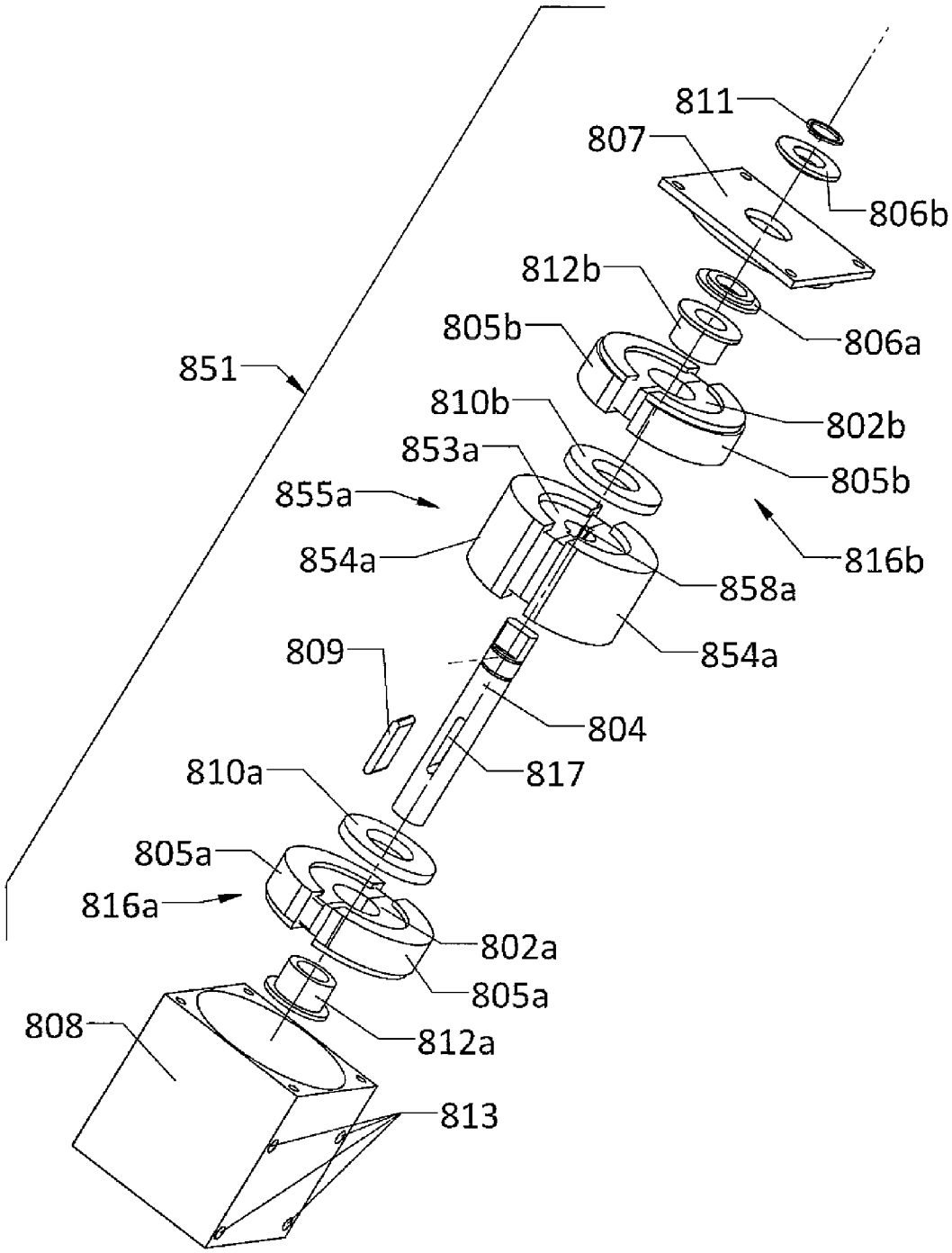
FIG. 19D is an oblique exploded view of a three-carrier platter, disc-based core elements, deep field apparatus that is spanner or shaft actuated.
Figure 20A:
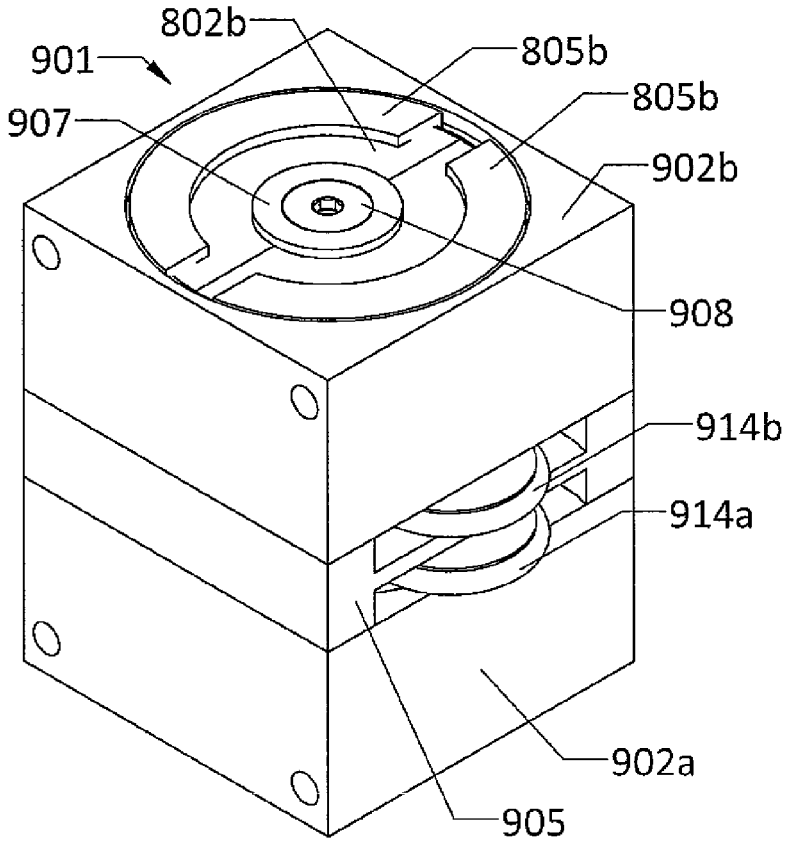
FIG. 20A is an oblique view of a four-carrier platter with independent actuation of isolated upper and lower magnetic field embodiment.
Figure 20B:
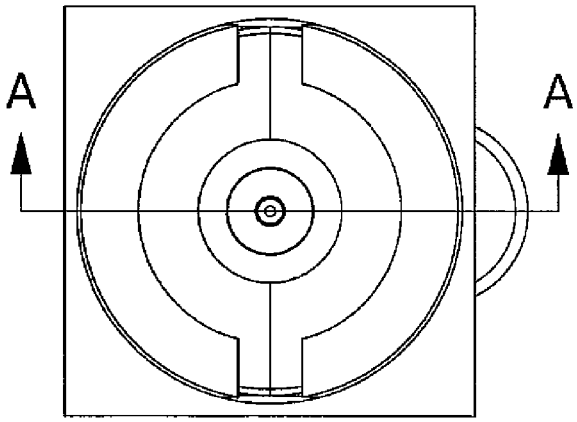
FIG. 20B is a plan view of the embodiment depicted in FIG. 20A.
Figure 20C:
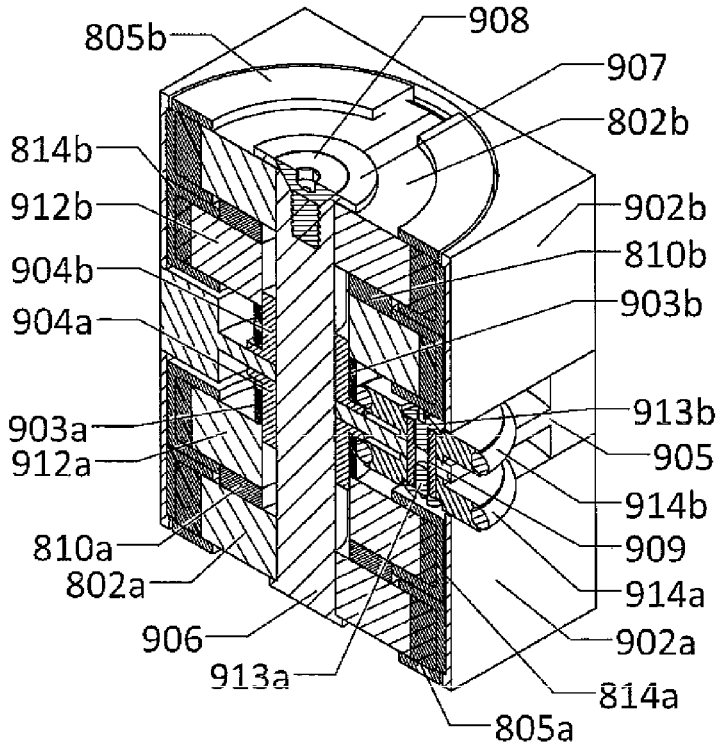
FIG. 20C is an oblique sectioned view of the embodiment depicted in FIG. 20A.
Figure 20D:
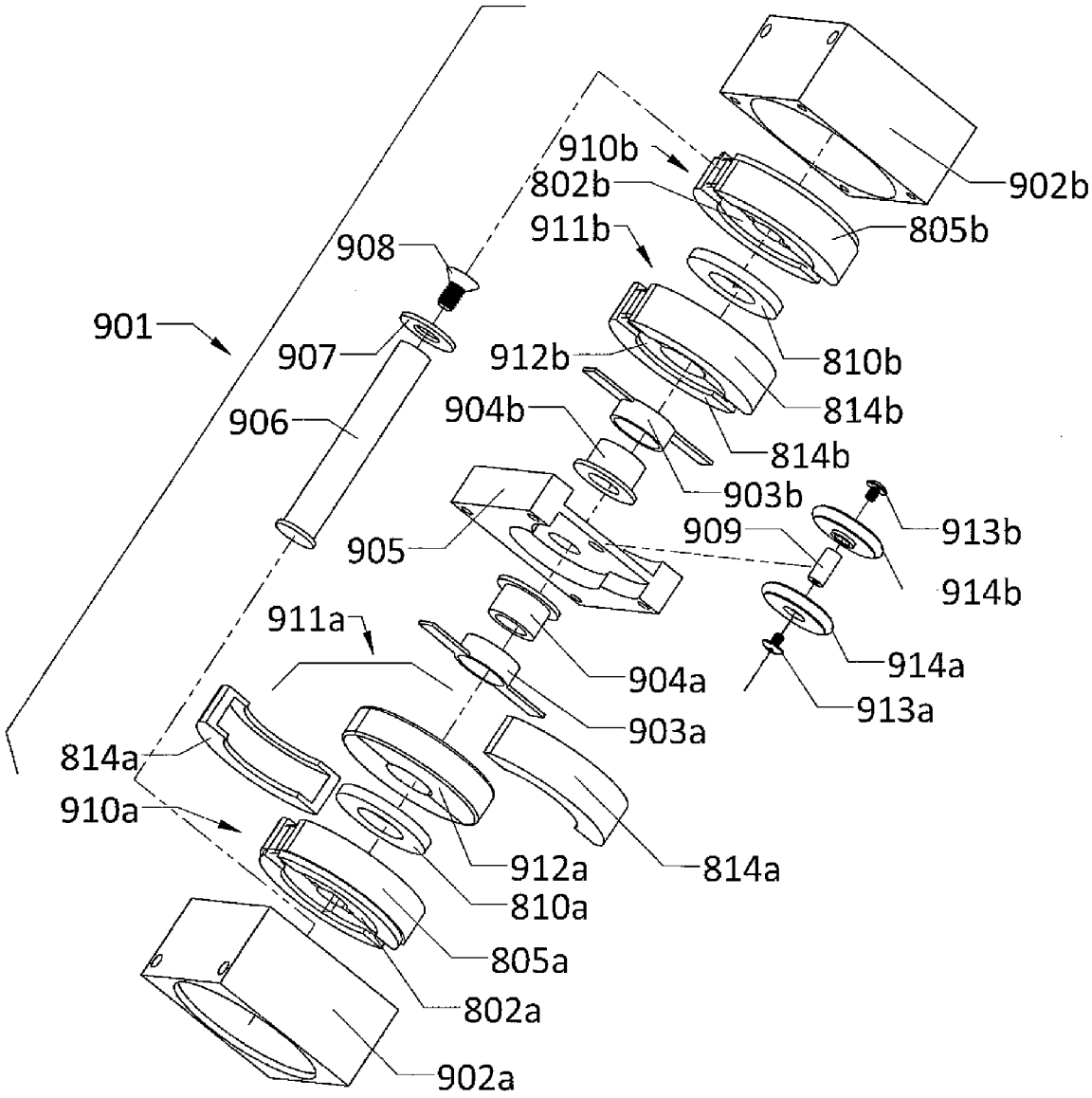
FIG. 20D is an oblique partially exploded view of the embodiment depicted in 20A.
Figure 21:
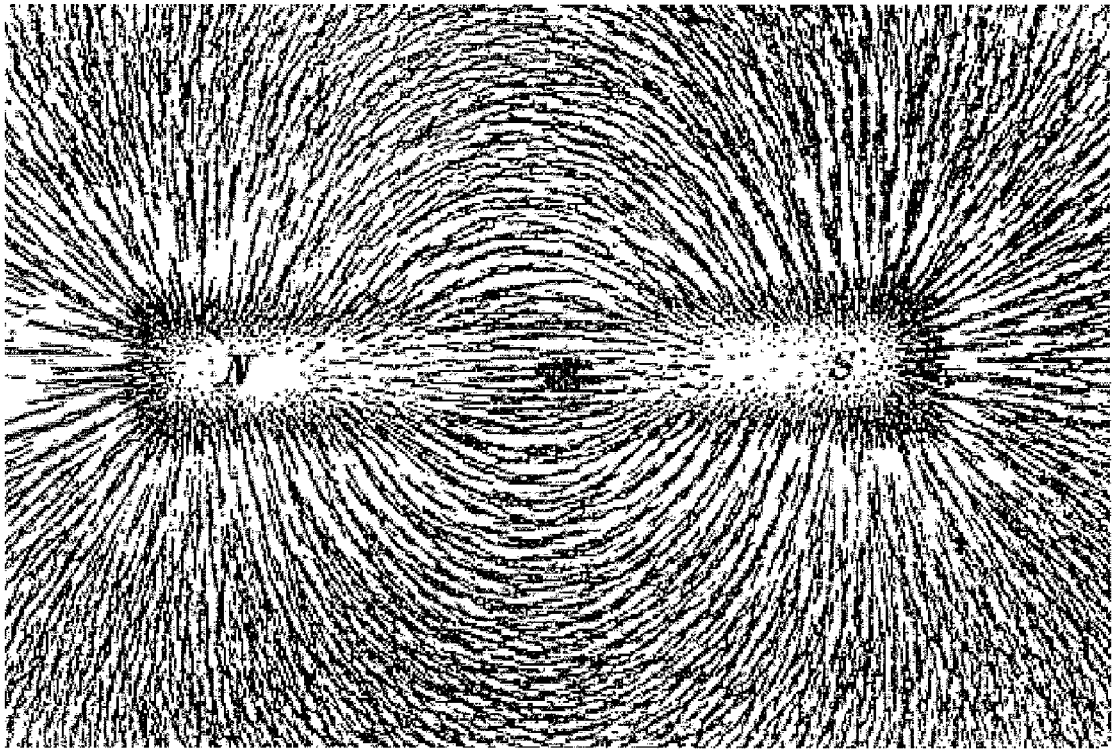
FIG. 21 is a visible two dimensional representation of a typical magnetic field.

Another embodiment 851 is shown in FIG. 19D. This embodiment substitutes a single center carrier platter assembly 855*a* that is approximately the equivalent thickness of the two inner carrier platters 815*a* and 815*b* depicted in Figure. The single, thicker, center carrier platter must be magnetically matched to the combined magnetic flux of the upper and lower carrier platters as the magnetic performance of the thicker magnet 853*a* may not be equivalent to that of the two outer thinner magnets 802*a* and 802*b*. The three-carrier platter arrangement contained within a housing may be actuated by a spanner or other device at the top of the shaft 804. The carrier platter assemblies are also core element assemblies similar to the core element describe in FIG. 7. They are comprised of diametrically polarized magnets 802*a*, 802*b*, and 853*a* with matched pole conduits 805*a*, 805*b*, and 854*a*, respectively. Shaft 804 rotates the inner core element/carrier platter assemblies 855*a*. To reduce friction, the use of polymer-based sleeve bearings 812*a* and 812*b* are indicated between shaft 804 and fixed core element/carrier platter assemblies 816*a* and 816*b*. In the case of applications requiring a high number of actuations (100,000 or more cycles), ball or roller bearings may be substituted.

Embodiment 851 is further comprised of a ferrous or nonferrous housing 808 with mounting holes 813 for attachment to fixtures or other mounting devices; PTFE discs 810*a* and 810*b* provide accurate low friction gaps between the center carrier platter 855*a* and the fixed outer carrier platter assemblies 816*a* and 816*b*; locating key 809 fits into slot 817 in shaft 804 and accurately locates the single center carrier platters 855*a* through keyed shaft holes 858*a*; rotational shaft 804 is affixed to the top lid 807 using shaft clip 811; low friction washers 806*a* and 806*b* are placed under clip 811 to reduce rotational friction further; and housing 808 has a retention feature (not shown) in the bottom of the housing and in the underside of lid 807 to orient the lower carrier platter assembly 816*a* with the upper carrier platter assembly 816*b*. This embodiment is readily actuated manually or through an automated method as depicted in FIG. 18A.

The embodiments of FIGS. 19A, 19B, 19C and 19D illustrate the use of a modified version of core element 351 identified in FIG. 7, though it may use any number of core elements or variations of the core elements identified earlier. Pole Surface Ratio of the Conduit must be accommodated as described earlier when using four carrier platters as the ratio is doubled when using four core elements as compared to two core elements. Embodiments 801 and 851 use standardized carrier platters that are interchangeable and configurable to the end use requirement. Rotational stops or detents may be integrated into the housing or be integral to a motor actuation system. Physical hard stops similar in nature to those shown in FIG. 16 or FIG. 17 may be added if the motor does not have internal provisions for rotational limitation (as is the case with a geared stepper motor).

The embodiment 901 depicted in FIGS. 20A, 20B, 20C, and 20D allows independent actuation of upper and lower carrier platter pairs. Independent actuation provides for separate target grip on top and bottom surfaces of the embodiment. Rotation of the friction thumbwheels 914*a* and 914*b* activate the respective magnet pairs within housing 902*a* and housing 902*b* independently. The angular rotation required is based on the ratio of the friction wheel 914*a* and 914*b* diameter and the knurl wheel 903*a* and 903*b* diameter. A single, shared shaft 906 allows for precise alignment and ease of manufacturing. This allows the user the ability to place the embodiment 901 onto a steel base in a machining center, activate the lower carrier platter pair, place the work material onto the top surface and activate it once work material is in the desired position. The isolation layer 905 that contains the friction drive mechanism is constructed of nonferrous material, preventing the majority of the magnetic field from the upper carrier platter pair from interacting with the magnetic field of the lower carrier platter pair. This isolation provides for independent target attraction on the top surface, as well as the bottom surface. While this apparatus contains four carrier platters, the pole surface ratio of the conduit is to be treated as two carrier platters due to the use of isolation layer 905.

The carrier platter assemblies 910*a*, 910*b*, 911*a*, and 911*b* are also core element assemblies similar to the core element described in FIG. 7. They are comprised of diametrically polarized magnets 802*a*, 802*b*, 912*a* and 912*b* with matched pole conduits 805*a*, 805*b*, 814*a* and 814*b*, respectively; shaft 906 is affixed to the outer carrier platter assemblies 910*a* and 910*b*. Activation of the lower pair of core elements 910*a* and 911*a* is achieved when carrier platter 911*a* is rotated to an in-phase position with respect to carrier platter 910*a* in a generally N-N/S-S orientation (ON). Likewise, deactivation occurs when carrier platter 911*a* is rotated to an out-of-phase N-S/S-N orientation (OFF) with respect to carrier platter 910*a*. Activation of the upper pair of core elements 910*b* and 911*b* is achieved when carrier platter 911*b* is rotated to an in-phase position with respect to carrier platter 910*b* in a generally N-N/S-S orientation (ON). Deactivation occurs when carrier platter 911*b* is rotated to an out-of-phase N-S/S-N orientation (OFF) with respect to carrier platter 910*b*.

The embodiment 901 consists of two identical carrier platter and housing assemblies with a nonferrous isolation layer in between. It is comprised of ferrous or nonferrous housings 902*a* and 902*b* affixed to carrier platter 910*a* and 910*b* respectively; PTFE spacers 810*a* and 810*b* provide for an accurate gap between the carrier platters previously described while reducing rotational friction; shouldered sleeve bearings 904*a* and 904*b* fit inside of knurl wheels 903*a* and 903*b*, respectively, and magnets 912*a* and 912*b*, respectively; a threaded spacer 909 is inserted into a hole in the isolation layer 905 and has friction wheels 914*a* and 914*b* slipped over the threaded spacer 909 on opposite sides of the isolation layer 905; screws 913*a* and 913*b* are tightened into threaded spacer 909; shaft 906 is inserted through the section described above; and washer 907 is placed onto the end of the shaft 906 and screw 908 affixes the shaft.

What is claimed is:

1. A method for making a switchable core element-based permanent magnet apparatus for holding and lifting a desired target comprising the steps of:

Providing for two core elements, separated from each other by an air gap or low friction material for the purpose of reducing the friction and facilitating the rotation between said core elements, each of which is comprised of one or more permanent magnets, and each of which is contained within a carrier platter, each permanent magnet having a magnetic north and south pole creating a magnetic north pole field and a magnetic south pole field, respectively, and two magnetically soft pole conduits, the magnetic poles of the permanent magnet or magnets each having a magnetic pole face and each being adjacent and affixed to the two magnetically soft pole conduits, said magnetically soft pole conduits being capable of containing and redirecting the magnetic field of the permanent magnet or magnets and oriented such that the magnetic north pole or poles of the permanent magnet or magnets are adjacent and affixed to one pole conduit and the magnetic south pole or poles of the permanent magnet or magnets are adjacent and affixed to the other pole conduit, a contact surface area defined by that surface area in which the permanent magnet or magnets touch the pole conduit, a work surface contact area defined by that surface in which the pole conduit comes into contact with a magnetic target, wherein:

a. Said pole conduits are matched to the permanent magnet or magnets to efficiently produce a north pole conduit (N) magnetic field and a south pole conduit (S) magnetic field while simultaneously conducting the magnetic field to the upper and lower surfaces of the core element, by:

1. Accommodating one or more permanent magnets which may be of different geometric shapes and sizes and which form a core element;
2. Encapsulating the magnetic pole faces of the permanent magnet or magnets within the pole conduits such that no more than ⅛ of the length between the north and south poles of the permanent magnet or magnets is inset into the pole conduits;
3. Constraining the contact surface area of each pole conduit to a height that is equal to or slightly taller than the height of the magnetic pole face of the permanent magnet or magnets;
4. Constraining the pole conduit work surface contact area, such that the calculated area of the pole conduit work surface contact area is between about 0.75 and 1.50 times the surface area of the magnet pole face surface; and 5. Constraining the pole conduit width to between about 25% and about 200% of the magnet pole face width;

b. Verifying that the matched core elements deactivate when the pole conduits are anti-aligned, that is, the majority if not all of the magnetic field emanating from the work surface contact area is neutralized, the core elements positioned such that the south pole conduit (S) of a first core element is juxtaposed with the north pole conduit (N) of a second adjacent core element and the north pole conduit (N) of the first core element is juxtaposed with the south pole conduit (S) of the second core element (S-N/N-S, and adjusting if necessary one or more core element's magnetic field strength to further neutralize the magnetic field emanating from the work surface contact area due to assembly or manufacturing requirements that may adversely affect the efficiency of the pole conduits' ability to conduct and redirect the north and south pole magnetic fields between adjacent core elements, by:

1. Confirming that the majority if not all of the magnetic field emanating from the work surface contact area is neutralized;
2. Modifying if desired or required one or more core elements to have a different strength magnetic field than an adjacent core element such that the residual magnetic field emanating from the work surface of the combined core elements has little or no residual magnetic field, by:
   i. Using a higher strength permanent magnet;
   ii. Using a larger permanent magnet mass for one or more of the permanent magnets;
   iii. Using a different geometric shape for one or more of the permanent magnets;
   iv. Using a different geometric size, composition, or shape of the pole conduit; or
   v. Using any combination of steps 2i through 2iv above;
3. Verifying that the matched core elements activate when the pole conduits are aligned, that is, the majority if not all of the magnetic field emanating from the work surface contact area is actuated when the core elements are positioned such that the south pole conduit (S) of the first core element is juxtaposed with the south pole conduit (S) of the second adjacent core element and the north pole conduit (N) of the first core element is juxtaposed with the north pole conduit (N) of the second core element;

c. Incorporating each of the two core elements into a separate carrier platter wherein each carrier platter constrains or holds the individual core element components such that the north and south pole conduits of the core elements are radially opposed in the same flat surface horizontal planes as the carrier platter, while providing for the orientation of adjacent core elements by:

1. Sizing the carrier platter such that the core element contained therein is substantially physically contained within the carrier platter dimensions; and
2. Providing a variety of means for insetting the core element within the carrier platter;

d. Combining the two carrier platters so that each carrier platter is vertically constrained to the carrier platter adjacent to it so that each carrier platter may rotate concentrically with respect to the carrier platter adjacent to but may not move non-concentrically with respect to the carrier platter adjacent to it, said carrier platters containing optional rotation limit features which facilitate alignment or anti-alignment of the north and south pole conduits contained within the adjacent carrier platters wherein:

1. The minimum thickness and composition of the low friction material or the size of the air gap is determined based on the number of anticipated cycles, that is, deactivation to activation, or activation to deactivation, that the apparatus will sustain in its life time;
2. Using means for aligning the carrier platters substantially about their center such that their relative movement is constricted as desired; and
3. Limiting the relative movement of the carrier platters such that the pole conduits contained within the carrier platters are anti-aligned and thereby deactivated at one limit of the relative movement and are aligned and thereby activated at the other limit of the relative movement.

2. A method for making a switchable core element-based permanent magnet apparatus for holding and lifting a desired target comprising the steps of:

Providing for three or more core elements, including two outer core elements and one or more inner core elements, separated from each other by an air gap or low friction material for the purpose of reducing the friction and facilitating the rotation between said core elements, each of which is comprised of one or more permanent magnets, and each of which is contained within a carrier platter, each permanent magnet having a magnetic north and south pole creating a magnetic north pole field and a magnetic south pole field, respectively, and two magnetically soft pole conduits, the magnetic poles of the permanent magnet or magnets each having a magnetic pole face and each being adjacent and affixed to the two magnetically soft pole conduits, said magnetically soft pole conduits being capable of containing and redirecting the magnetic field of the permanent magnet or magnets and oriented such that the magnetic north pole or poles of the permanent magnet or magnets are adjacent and affixed to one pole conduit and the magnetic south pole or poles of the permanent magnet or magnets are adjacent and affixed to the other pole conduit, a contact surface area defined by that surface area in which the permanent magnet or magnets touch the pole conduit, a work surface contact area defined by that surface in which the pole conduit comes into contact with a magnetic target, wherein:

a. Said pole conduits are matched to the permanent magnet or magnets to efficiently produce a north pole conduit (N) magnetic field and a south pole conduit (S) magnetic field while simultaneously conducting the magnetic field to the upper and lower surfaces of the core element, by:

1. Accommodating one or more permanent magnets which may be of different geometric shapes and sizes and which form a core element;
2. Encapsulating the magnetic pole faces of the permanent magnet or magnets within the pole conduits such that no more than ⅛ of the length between the north and south poles of the permanent magnet or magnets is inset into the pole conduits;
3. Constraining the contact surface area of each pole conduit to a height that is equal to or slightly taller than the height of the magnetic pole face of the permanent magnet or magnets;
4. Constraining the pole conduit work surface contact area, such that the calculated area of the pole conduit work surface contact area is between about 0.75 and 1.50 times the surface area of the magnet pole face surface; and 5. Constraining the pole conduit width to between about 25% and about 200% of the magnet pole face width;

b. Verifying that the matched core elements deactivate when the pole conduits are anti-aligned, that is, the majority if not all of the magnetic field emanating from the work surface contact area or work surface contact areas is neutralized, and adjusting if necessary one or more core element's magnetic field strength to further neutralize the magnetic field emanating from the work surface contact area due to assembly or manufacturing requirements that may adversely affect the efficiency of the pole conduits' ability to conduct and redirect the north and south pole magnetic fields between adjacent core elements, by:

1. Confirming that the majority if not all of the magnetic field emanating from the work surface contact area is neutralized;
2. Modifying if desired or required one or more core elements to have a different strength magnetic field than an adjacent core element such that the residual magnetic field emanating from the work surface of the combined core elements has little or no residual magnetic field, by:
   i. Using a higher strength permanent magnet;
   ii. Using a larger permanent magnet mass for one or more of the permanent magnets;
   iii. Using a different geometric shape for one or more of the permanent magnets;
   iv. Using a different geometric size, composition, or shape of the pole conduit; or
   v. Using any combination of steps 2i through 2iv above;
3. verifying that the matched core elements activate when the pole conduits are aligned, that is, the majority if not all of the magnetic field emanating from the work surface contact area is actuated;

c. Incorporating each of the core elements into a separate carrier platter wherein each carrier platter constrains or holds the individual core element components such that the north and south pole conduits of the core elements are radially opposed in the same flat surface horizontal planes as the carrier platter, while providing for the orientation of adjacent core elements by 1. Sizing the carrier platter such that the core element contained therein is substantially physically contained within the carrier platter dimensions; and
2. Providing a variety of means for insetting the core element within the carrier platter;

d. Combining the carrier platters affixed to each other, including the two outer carrier platters and one or more inner carrier platters, so that each carrier platter is vertically constrained to the carrier platter adjacent to it so that each carrier platter may rotate concentrically with respect to the carrier platter adjacent to it but may not move non-concentrically with respect to the carrier platter adjacent to it, said carrier platters containing optional rotation limit features which facilitate alignment or anti-alignment of the north and south pole conduits contained within the adjacent carrier platters wherein:

1. The minimum thickness and composition of the low friction material or the size of the air gap is determined based on the number of anticipated cycles, that is, deactivation to activation, or activation to deactivation, that the apparatus will sustain in its life time;
2. Using means for aligning the carrier platters substantially about their center such that their relative movement is constricted as desired; and
3. Limiting the relative movement of the carrier platters such that the pole conduits contained within the carrier platters are anti-aligned and thereby deactivated at one limit of the relative movement and are aligned and thereby activated at the other limit of the relative movement.

3. The method for making a switchable core element-based permanent magnet apparatus of claim 2 wherein four carrier platters are separated into an upper pair of carrier platters containing an upper first outer carrier platter and an upper second inner carrier platter, an upper work surface contact area located on the outside surface of the upper first outer carrier platter, and a lower pair of carrier platters containing a lower third inner carrier platter and a lower fourth outer carrier platter, a lower work surface contact area located on the outside surface of the lower fourth outer carrier platter, but with a non magnetic material, low friction material, or air gap of sufficient size separating the upper second inner carrier platter and the lower third inner carrier platter such that the magnetic field emanating from the upper pair of carrier platters does not have a substantial effect on the magnetic field of the lower pair of carrier platters, and such that the magnetic field emanating from the lower pair of carrier platters does not have a substantial effect on the magnetic field of the upper pair of carrier platters, such that the matched core elements:

deactivate the upper pair of core elements when the pole conduits are anti-aligned, that is, the majority if not all of the magnetic field emanating from the upper pair of carrier platters into the upper work surface contact area is neutralized, such that the south pole conduit (S) contained within the core element of the upper first carrier platter is juxtaposed with the north pole conduit (N) within the core element of the adjacent second inner carrier platter and the north pole conduit (N) contained within the core element of the upper first carrier platter is juxtaposed with the south pole conduit (S) within the core element of the adjacent second inner carrier platter;

deactivate the lower pair of core elements, when the pole conduits are anti-aligned, that is, the majority if not all of the magnetic field emanating from the lower pair of carrier platters into the lower work surface contact area is neutralized, such that the south pole conduit (S) contained within the core element of the lower fourth carrier platter is juxtaposed with the north pole conduit (N) within the core element of the adjacent third inner carrier platter and the north pole conduit (N) contained within the core element of the lower fourth carrier platter is juxtaposed with the south pole conduit (S) within the core element of the adjacent third inner carrier platter;

activate the upper pair of core elements when the pole conduits are aligned, that is, the majority if not all of the magnetic field emanating from the upper pair of carrier platters into the upper work surface contact area is actuated, such that the south pole conduit (S) contained within the core element of the upper first carrier platter is juxtaposed with the south pole conduit (S) within the core element of the adjacent second inner carrier platter and the north pole conduit (N) contained within the core element of the upper first carrier platter is juxtaposed with the north pole conduit (N) within the core element of the adjacent second inner carrier platter; and activate the lower pair of core elements, when the pole conduits are aligned, that is, the majority if not all of the magnetic field emanating from the lower pair of carrier platters into the lower work surface contact area is actuated, such that the south pole conduit (S) contained within the core element of the lower fourth carrier platter is juxtaposed with the north pole conduit (N) within the core element of the adjacent third inner carrier platter and the north pole conduit (N) contained within the core element of the lower fourth carrier platter is juxtaposed with the south pole conduit (S) within the core element of the adjacent third inner carrier platter.

4. The method for making a switchable core element-based permanent magnet apparatus of claim 1, 2, or 3 wherein one or more of the core elements is also a carrier platter such that one or more core elements comprises one or more permanent magnets combined within a single piece ferrous carrier platter in place of the two pole conduits, while providing the necessary isolation of the north and south magnetic poles of one or more permanent magnets from each other by removing the ferrous material along the permanent magnet's or magnets' magnetic pole separation line or lines, so that the carrier platter operates effectively as two separate pole conduits.

5. The method for making a switchable core element-based permanent magnet apparatus of claim 4 further combining two or more carrier platters constructed of any combination of ferrous and or non-ferrous carrier platters with any or all of the following:

a. Using two or more different configurations of carrier platters wherein one or more of the carrier platters has a magnetically stronger core element than an adjacent core element;

b. Providing for the combination of different geometric shapes of permanent magnets and pole conduits used in one or more carrier platters such that when the apparatus is deactivated, little or no residual magnetic field emanates from the pole conduits that come into contact with the desired target; and c. Providing for a nonferrous isolation layer surrounding, encapsulating, or adjacent to one or more carrier platters' pole conduits which do not come into contact with the magnetic target such that the excess residual magnetic field emanating from the pole conduits when deactivated is effectively isolated from outside ferrous materials and or unintended magnetic targets.

6. The method for making a switchable core element-based permanent magnet apparatus as in claim 5 wherein the friction between carrier platters is reduced by friction-reducing means.

7. The method for making a switchable core element-based permanent magnet apparatus as in claim 6 wherein the holding and lifting force between the desired target and the pole conduits that come into contact with the desired target is improved by holding and lifting force improvement means.

8. The method for making a switchable core element-based permanent magnet apparatus as in claim 7 wherein a variable magnetic field is attained by partial alignment or anti-alignment of one or more carrier platters with respect to other carrier platters.

* * * * *